US005781875A

United States Patent [19]

Maki et al.

[11] Patent Number: 5,781,875

[45] Date of Patent: *Jul. 14, 1998

[54] FUEL METERING CONTROL SYSTEM FOR INTERNAL COMBUSTION ENGINE

[75] Inventors: Hidetaka Maki; Shusuke Akazaki; Yusuke Hasegawa; Isao Komoriya, all of Wako, Japan

[73] Assignee: Honda Giken Kogyo Kabushiki Kaisha, Tokyo, Japan

[ * ] Notice: The term of this patent shall not extend beyond the expiration date of Pat. No. 5,558,076.

[21] Appl. No.: 606,384

[22] Filed: Feb. 23, 1996

[30] Foreign Application Priority Data

Feb. 25, 1995 [JP] Japan ..... 7-061663

[51] Int. Cl.[6] ..... G06G 7/70

[52] U.S. Cl. ..... 701/104; 701/102; 701/103; 123/673; 123/480

[58] Field of Search ..... 364/431.01, 431.03, 364/431.04, 431.051, 431.052, 431.053; 123/675, 674, 673, 679, 698, 480, 677, 694, 680, 696, 478, 492, 687; 60/274, 276, 277, 285, 289; 73/119 A, 116, 198 D, 117.3, 118.2

[56] References Cited

U.S. PATENT DOCUMENTS

| | | | |
|---|---|---|---|
| 5,349,933 | 9/1994 | Hasegawa et al. | 123/486 |
| 5,367,462 | 11/1994 | Klenk et al. | 364/431.052 |
| 5,448,978 | 9/1995 | Hasegawa et al. | 123/480 |
| 5,462,037 | 10/1995 | Hasegawa et al. | 123/673 |
| 5,548,514 | 8/1996 | Hasegawa et al. | 364/431.051 |
| 5,549,092 | 8/1996 | Hasegawa et al. | 123/478 |
| 5,558,075 | 9/1996 | Maki et al. | 123/680 |
| 5,558,076 | 9/1996 | Maki et al. | 123/687 |
| 5,572,977 | 11/1996 | Shibata et al. | 364/431.051 |
| 5,590,638 | 1/1997 | Nishimura et al. | 123/687 |
| 5,606,959 | 3/1997 | Maki et al. | 364/431.051 |
| 5,629,853 | 5/1997 | Ogawa et al. | 364/431.051 |
| 5,632,261 | 5/1997 | Maki et al. | 123/674 |
| 5,636,621 | 6/1997 | Maki et al. | 123/673 |

FOREIGN PATENT DOCUMENTS

| | | |
|---|---|---|
| 2-275043 | 11/1990 | Japan . |
| 4-209940 | 7/1992 | Japan . |
| 5-52140 | 3/1993 | Japan . |
| 7-247886 | 9/1995 | Japan . |

OTHER PUBLICATIONS

"Digital Adaptive Control" *Computrol*, No. 27, Jul. 10, 1989, pp. 28–41.

"Automatic Control Handbook", Ohm, Ltd., Japan, pp. 701–707. No Date.

"A Survey of Model Reference Adaptive Techniques—Theory and Applicatoins", LANDAU, *Automatica*, vol. 10, 1974, pp. 353–379.

"Unification of Discrete Time Explicit Model Reference Adaptive Control Designs", Landau et al, *Automatica*, vol. 17, No. 4, 1981, pp. 593–611.

"Combining Model Reference Adaptive Controllers and Stochastic Self-tuning Regulators", Landau, *Automatica*, vol. 18, No. 1, 1982, pp. 77–84.

*Primary Examiner*—Jacques H. Louis-Jacques

*Attorney, Agent, or Firm*—Nikaido, Marmelstein, Murray & Oram LLP

[57] ABSTRACT

A system for controlling fuel metering for an internal combustion engine provided with a first feedback loop that calculates a first feedback correction coefficient using an adaptive control law to correct a quantity of fuel injection such that a detected air/fuel ratio is brought to a desired air/fuel ratio, a second feedback loop that calculates a second coefficient using a PID control law to similarly correct the quantity of fuel injection, and a third feedback loop that calculates a third coefficient using a PID controller to correct the quantity of fuel injection such that air/fuel ratio variance among the cylinders decreases. Either of the first or second coefficient is selected and based on the selected coefficient, the feedback gains of the third feedback loop are determined.

63 Claims, 13 Drawing Sheets

FUEL METERING CONTROL SYSTEM FOR INTERNAL COMBUSTION ENGINE

BACKGROUND OF THE INVENTION

1. Field of the Invention

This invention relates to a fuel metering control system for an internal combustion engine.

2. Description of the Related Art

The PID control law is ordinarily used for fuel metering control for internal combustion engines. The control error between a desired value and a controlled variable (plant output) is multiplied by a P term (proportional term), an I term (integral term) and a D term (differential or derivative term) to obtain a feedback correction coefficient (feedback gain). In addition, it has recently been proposed to obtain the feedback correction coefficient by use of modern control theory or the like. Since the feedback correction coefficient has a relatively high control response when calculated based on the modern control theory, a controlled variable may sometimes oscillate, contrary to what is expected, depending on the engine operating condition, thereby degrading control stability.

In order to solve the problem, Japanese Laid-Open Patent Application Hei 4(1992)-209,940 proposes a fuel metering control system in which a first feedback correction coefficient is determined based on the modern control theory, while determining a second feedback correction coefficient, whose control response is inferior to the first coefficient, based on a PID control law, and the manipulated variable is determined using the second coefficient under a specific engine operating condition where combustion is not stable such as a vehicle deceleration. For a similar reason, Japanese Laid-Open Patent Application No. Hei 5(1993)-52,140 proposes determining a manipulated variable using a feedback correction coefficient of a less response in a period during which the air/fuel ratio sensor has not been activated completely. Moreover, the assignee proposes in Japanese Laid-Open Patent Application Hei 7(1995)-247,886 a fuel metering control system using an adaptive controller.

In such a fuel metering control system having a feedback loop, when a second feedback loop is to be added to decrease air/fuel ratio variance among engine cylinders, there arises a problem of how to determine the control response (feedback gain(s)) of the additional feedback loop. Specifically, if making the gains of the two feedback loops to be high, the system will be liable to oscillate. On the other hand, from the viewpoint of improving control convergence, the feedback gains should preferably be high. The prior art references have not taught how to keep balance between these inconsistent demands.

SUMMARY OF THE INVENTION

An object of the invention is therefore to provide a fuel metering control system for an internal combustion engine having a first feedback loop and a second feedback loop to decrease air/fuel ratio variance among cylinders, which can determine control response of the second feedback loop appropriately, thereby improving control performance of the system.

Moreover, in the first feedback loop, although the feedback correction coefficient of higher control response enhances convergence, it makes the system to be apt to oscillate, in particular when, for example, the engine operating condition has returned from an open-loop to a feedback control region. In addition, since the two feedback correction coefficients are different in characteristics from each other in the first feedback loop, switching from one to the other will cause a manipulated variable to change sharply, degrading control stability.

A second object of the invention is therefore to provide a fuel metering control system for an internal combustion engine with a first feedback loop having feedback correction coefficients, different in control response, and a second feedback loop to decrease air/fuel ratio variance among cylinders, which can allow a smooth switching of the coefficients in the first feedback loop to enhance, while ensuring control stability, control performance of the system.

This invention achieves the object by providing a system for controlling fuel metering for an internal combustion engine having a plurality of cylinders and an exhaust system, said system comprising, an air/fuel ratio sensor installed in said exhaust system of the engine for detecting an air/fuel ratio of the engine, engine operating condition detecting means for detecting engine operating conditions including at least engine speed and engine load, fuel injection quantity determining means, operatively coupled to said engine operating condition detecting means, for determining a quantity of fuel injection for a cylinder of the engine based on at least the detected engine operating conditions, a first feedback loop means having a first controller means for calculating a first feedback correction coefficient, using a control law expressed in a recursion formula, to correct the quantity of fuel injection, such that a controlled variable obtained based on at least the detected air/fuel ratio detected by said air/fuel ratio sensor is brought to a desired value, a second feedback loop means having a second controller means for calculating a second feedback correction coefficient, using a control law whose control response is less than that of the first control law, to correct the quantity of fuel injection such that the controlled variable is brought to the desired value, a third feedback loop means having a third controller means for calculating a third feedback correction coefficient using a control constant, to correct the quantity of fuel injection for individual cylinders, such that air/fuel ratio variance among the cylinders decreases, selecting means for selecting one of the first feedback correction coefficient and the second feedback correction coefficient in response to the detected engine operating conditions, output fuel injection quantity determining means operatively coupled to said fuel injection quantity determining means, said first feedback loop means, said second feedback loop means, and said third feedback loop means, for correcting the quantity of fuel injection based on the selected feedback correction coefficient and the third feedback correction coefficient to determine an output quantity of fuel injection, and a fuel injector means operatively coupled to said output fuel injection quantity determining means, for injecting fuel in the cylinder of the engine based on the determined output quantity of fuel injection. In the system, coefficient discriminating means is operatively coupled to said selecting means for discriminating which of the first feedback correction coefficient and the second feedback correction coefficient is selected, and said third controller means determines the control constant to calculate the third feedback correction coefficient based on the selected feedback correction coefficient.

BRIEF EXPLANATION OF THE DRAWINGS

These and other objects and advantages of the invention will be more apparent from the following description and drawings, which show the invention by way of example only, and in which.

DETAILED DESCRIPTION OF THE PREFERRED EMBODIMENTS

Embodiments of the invention, given by way of example only, will now be explained with reference to the drawings.

Figure 1:
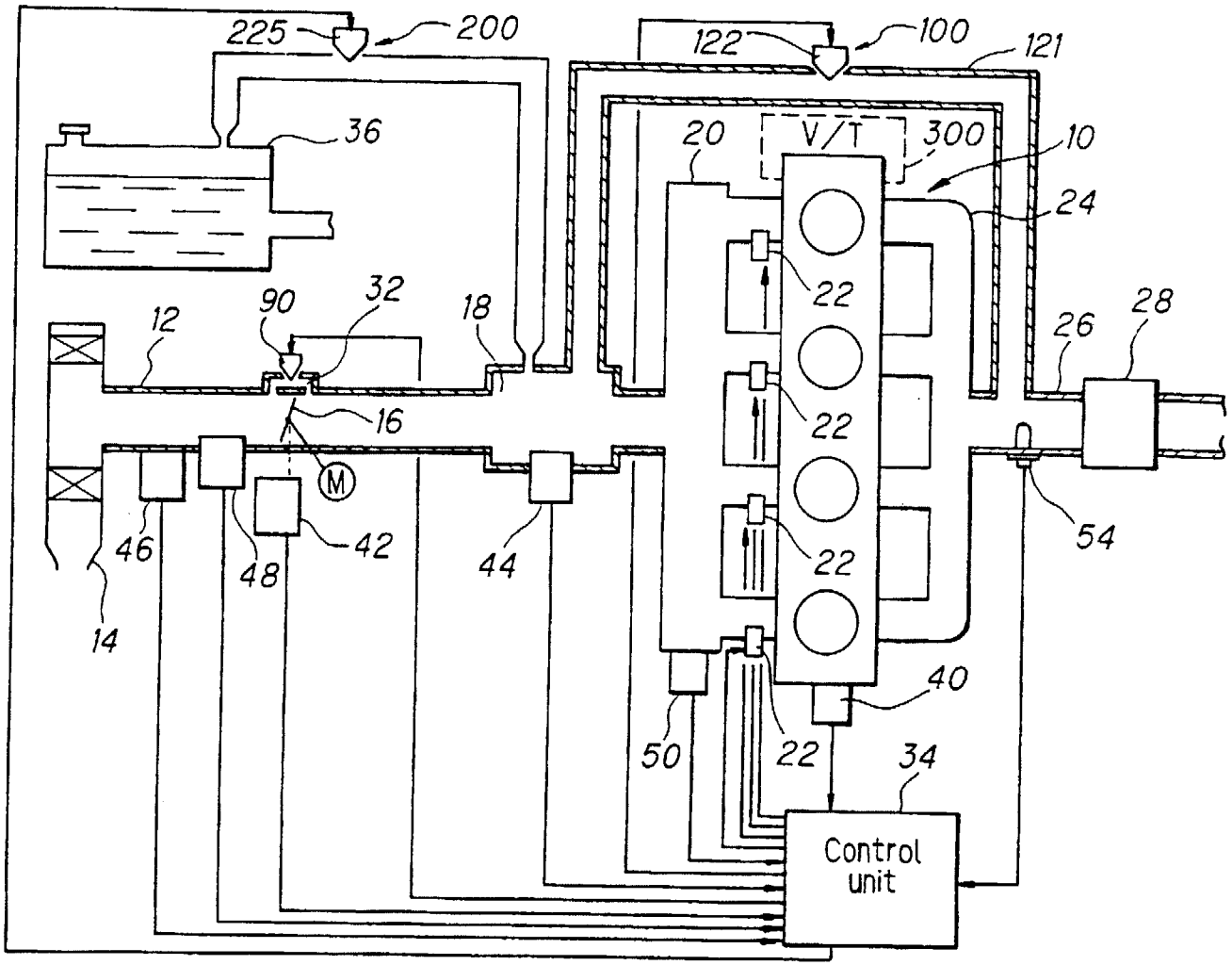
FIG. 1 is an overall schematic view showing a fuel metering control system for an internal combustion engine according to the present invention.

FIG. 1 is an overview of a fuel metering control system for an internal combustion engine according to the invention.

Reference numeral 10 in this figure designates an overhead cam (OHC) in-line four-cylinder (multi-cylinder) internal combustion engine. Air drawn into an air intake pipe 12 through an air cleaner 14 mounted on a far end thereof is supplied to each of the first to fourth cylinders through a surge tank 18, an intake manifold 20 and two intake valves (not shown), while the flow thereof is adjusted by a throttle valve 16. A fuel injector (fuel injection means) 22 is installed in the vicinity of the intake valves of each cylinder for injecting fuel into the cylinder. The injected fuel mixes with the intake air to form an air-fuel mixture that is ignited in the associated cylinder by a spark plug (not shown) in the firing order of #1, #3, #4 and #2 cylinder. The resulting combustion of the air-fuel mixture drives a piston (not shown) down.

The exhaust gas produced by the combustion is discharged through two exhaust valves (not shown) into an exhaust manifold 24, from where it passes through an exhaust pipe 26 to a catalytic converter (three-way catalyst) 28 where noxious components are removed therefrom before it is discharged to the exterior. Not mechanically linked with the accelerator pedal (not shown), the throttle valve 16 is controlled to a desired degree of opening by a stepping motor M. In addition, the throttle valve 16 is bypassed by a bypass 32 provided at the air intake pipe 12 in the vicinity thereof.

The engine 10 is equipped with an exhaust gas recirculation (EGR) mechanism 100 which recirculates a part of the exhaust gas to the intake side via a recirculation pipe 121, and a canister purge mechanism 200 connected between the air intake system and a fuel tank 36.

Figure 2:
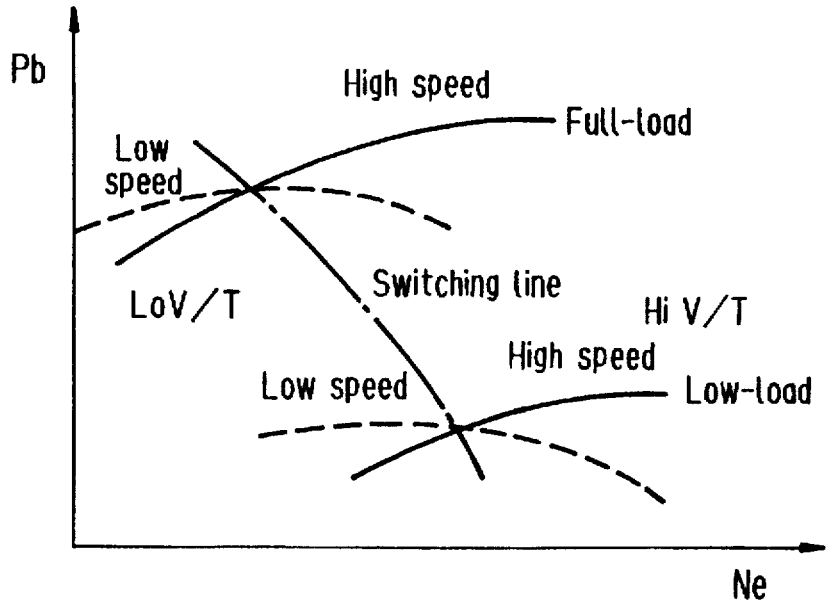
FIG. 2 is a graph showing the valve timing characteristics of a variable valve timing mechanism illustrated in FIG. 1.

The engine 10 is also equipped with a variable valve timing mechanism 300 (denoted as V/T in FIG. 1). As taught by Japanese Laid-open Patent Application No. Hei 2(1990)-275,043, for example, the variable valve timing mechanism 300 switches the opening/closing timing of the intake and/or exhaust valves between two types of timing characteristics: a characteristic for low engine speed designated LoV/T, and a characteristic for high engine speed designated HiV/T in response to engine speed Ne and manifold pressure Pb, as shown in FIG. 2. Since this is a wellknown mechanism, however, it will not be described further here. (Among the different ways of switching between valve timing characteristics is included that of deactivating one of the two intake valves.)

The engine 10 of FIG. 1 is provided in its ignition distributor (not shown) with a crank angle sensor 40 for detecting the piston crank angle and is further provided with a throttle position sensor 42 for detecting the degree of opening of the throttle valve 16, and a manifold absolute pressure sensor 44 for detecting the pressure Pb of the intake manifold downstream of the throttle valve 16 in terms of absolute value. An atmospheric pressure sensor 46 for detecting atmospheric pressure Pa is provided at an appropriate portion of the engine 10, an intake air temperature sensor 48 for detecting the temperature of the intake air is provided upstream of the throttle valve 16, and a coolant temperature sensor 50 for detecting the temperature of the engine coolant is also provided at an appropriate portion of the engine. The engine 10 is further provided with a valve timing (V/T) sensor 52 (not shown in FIG. 1) which detects the valve timing characteristic selected by the variable valve timing mechanism 300 based on oil pressure.

Further, an air/fuel sensor 54 constituted as an oxygen detector or oxygen sensor is provided in the exhaust pipe 26 at, or downstream of, a confluence point in the exhaust system, between the exhaust manifold 24 and the catalytic converter 28, where it detects the oxygen concentration in the exhaust gas at the confluence point and produces a corresponding signal (explained later). The outputs of the sensors are sent to the control unit 34.

Figure 3:
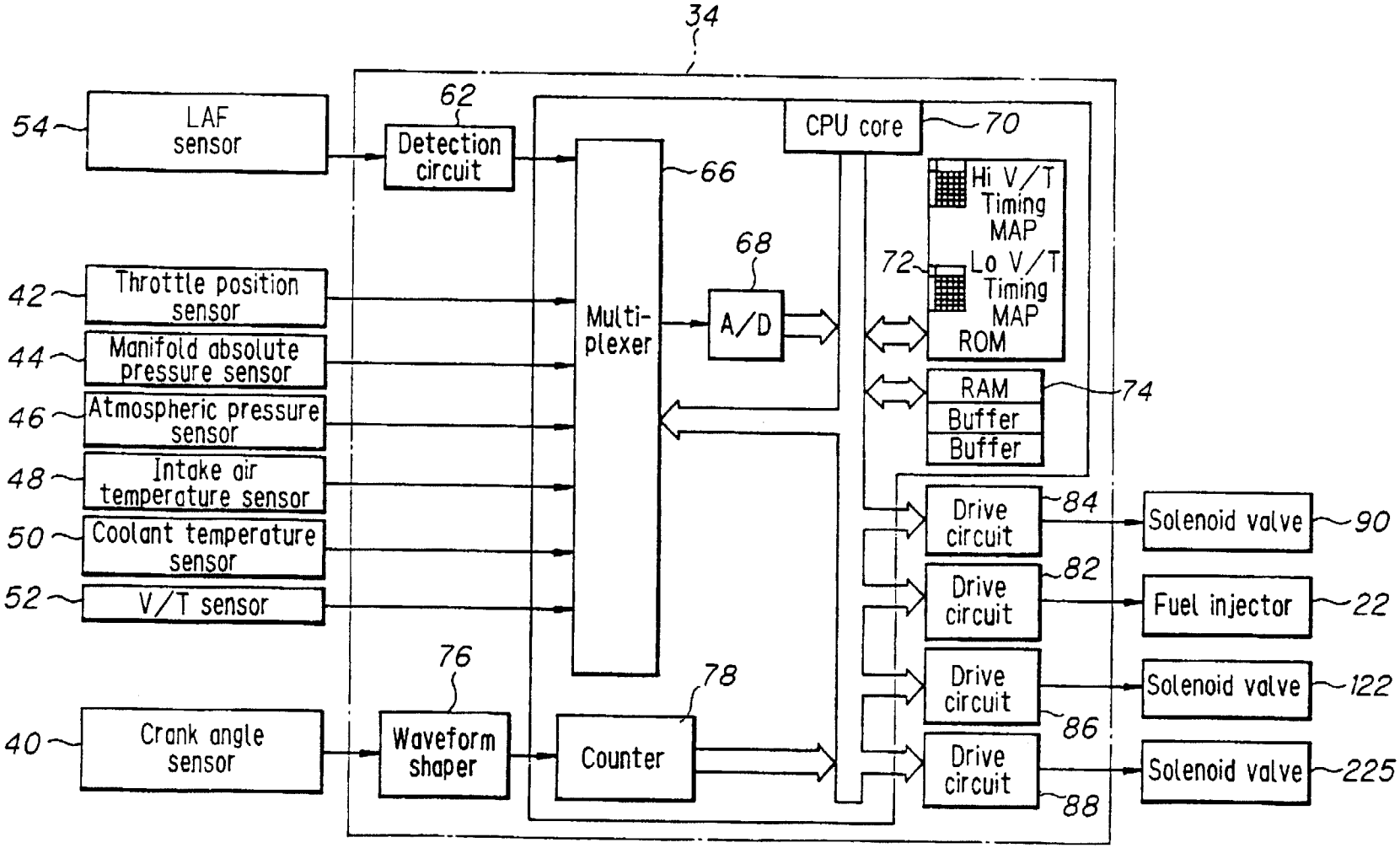
FIG. 3 is a block diagram showing the details of a control unit illustrated in FIG. 1.

Details of the control unit 34 are shown in the block diagram of FIG. 3. The output of the air/fuel ratio sensor 54 is received by a detection circuit 62, where it is subjected to appropriate linearization processing for producing an output in voltage characterized in that it varies linearly with the oxygen concentration of the exhaust gas over a broad range extending from the lean side to the rich side. (The air/fuel ratio sensor is denoted as "LAF sensor" in the figure and will be so referred to in the remainder of this specification.)

The output of the detection circuit 62 is forwarded through a multiplexer 66 and an A/D converter 68 to a CPU (central processing unit). The CPU has a CPU core 70, a ROM (read-only memory) 72 and a RAM (random access memory) 74, and the output of the detection circuit 62 is A/D-converted once every prescribed crank angle (e.g., 15 degrees) and stored in buffers of the RAM 74. Similarly, the analog outputs of the throttle position sensor 42, etc., are input to the CPU through the multiplexer 66 and the A/D converter 68 and stored in the RAM 74.

The output of the crank angle sensor 40 is shaped by a waveform shaper 76 and has its output value counted by a counter 78. The result of the count is input to the CPU. In accordance with commands stored in the ROM 72, the CPU core 70 computes a manipulated variable in the manner described later and drives the fuel injectors 22 of the respective cylinders via a drive circuit 82. Operating via drive circuits 84, 86 and 88, the CPU core 70 also drives a solenoid valve (EACV) 90 (for opening and closing the bypass 32 to regulate the amount of secondary air), a solenoid valve 122 for controlling the aforesaid exhaust gas recirculation, and a solenoid valve 225 for controlling the aforesaid canister purge.

Figure 4:
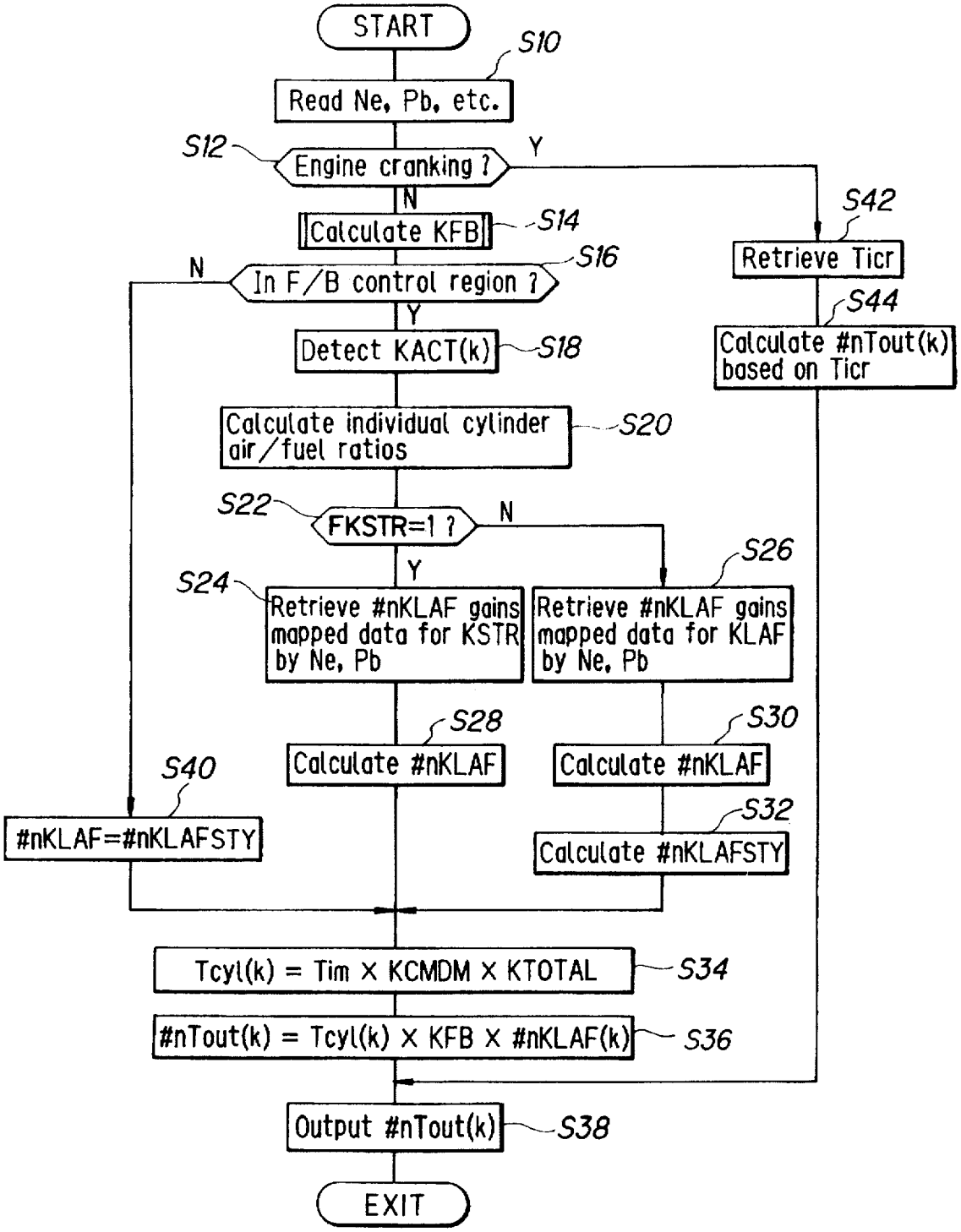
FIG. 4 is a flowchart showing the operation of the system according to the invention.

FIG. 4 is a flowchart showing the operation of the system. The program is activated at a predetermined crank angular position such as every TDC (Top Dead Center) of the engine.

Before entering the explanation of FIG. 4, the operation of the system will first be described with reference to FIG. 5, which is a block diagram illustrating the operation of the system more functionally.

As illustrated, the system is provided with a first feedback loop having an adaptive controller (Self-tuning regulator type adaptive controller; indicated as an "STR controller" in the figure) which uses the adaptive control law expressed in a recursion formula to calculate a first feedback correction coefficient (indicated as "KSTR(k)" in the figure) so as to bring the detected air/fuel ratio (indicated as "KACT(k)") to a desired air/fuel ratio (indicated as "KCMD(k)") using the basic quantity of fuel injection (indicated as "Tim") as the manipulated variable. Here, k means a sample number in the discrete time system.

At the same time, the system is provided with a second feedback loop having a PID controller (indicated as "PID" in the left of the figure) which uses a second type of control law, specifically a PID control law, to calculate a second feedback correction coefficient (indicated as "KLAF"), that is inferior in control response (lesser in control response) to the first feedback correction coefficient, so as to cause the detected air/fuel ratio KACT to equal the desired value KCMD similarly using the quantity of fuel injection Tim as the manipulated variable.

Either of the first or second feedback correction coefficients KSTR, KLAF is selected in response to the engine operating condition in the manner described latter, and the basic quantity of fuel injection Tim (calculated in a feed-forward system in accordance with an empirically determined characteristic and stored as mapped data that are retrievable by engine speed and manifold pressure) is multiplied by the selected coefficient KSTR or KLAF to obtain the output quantity of fuel injection Tout.

In addition, the system is further provided with a third feedback loop, inside the first and second feedback loops, having a PID controller (indicated as "PID" in the right of the figure) to calculate a third feedback correction coefficient for individual cylinders (indicated as "#nKLAF; here n: cylinder number), so as to decrease air/fuel ratio variance in among the four cylinders. In the third feedback loop, the air/fuel ratios at the individual cylinders are obtained through an observer that estimates the individual cylinder air/fuel ratios based on the output of the single LAF sensor 54, as will be explained later.

The operation of the system will now be explained with reference to FIG. 4.

In FIG. 4, the program starts at S10 in which the detected engine speed Ne and the manifold pressure Pb, etc., are read, and proceeds to S12 in which it is checked whether the engine is cranking, and if it is not, to S14 in which a feedback correction coefficient KFB (general name of the aforesaid coefficients KSTR, KLAF) is calculated.

Figure 6:
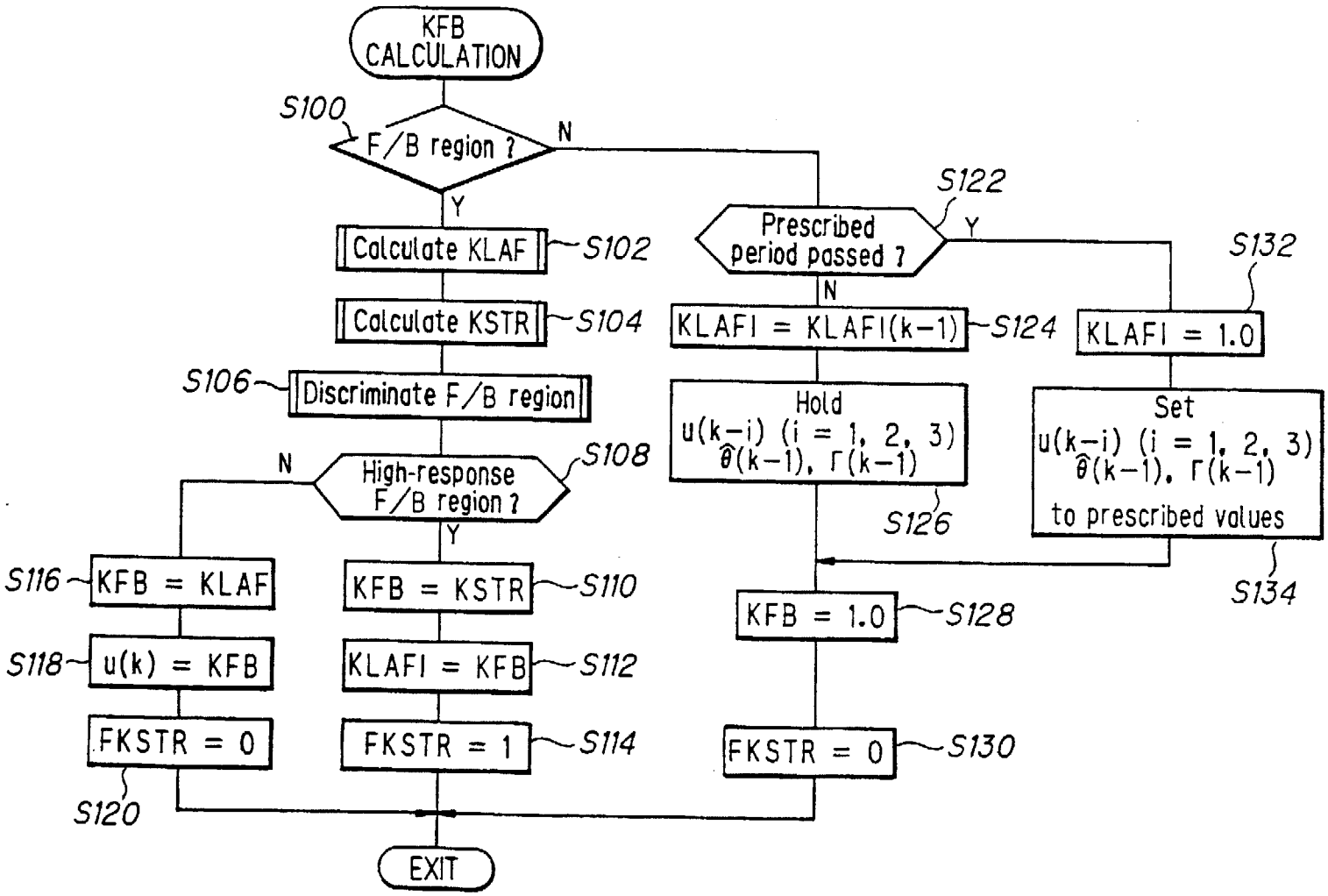
FIG. 6 is a subroutine flowchart of FIG. 4 showing the calculation of a feedback correction coefficient KFB referred to in FIG. 4.

FIG. 6 is a flowchart showing the calculation of the feedback correction coefficient KFB.

The program starts at S100 in which it is checked whether the engine operation is in a feedback control region. This is conducted using a separate subroutine not shown in the drawing. Fuel metering is controlled in an open-loop fashion, for example, such as during full-load enrichment or high engine speed, or when the engine operating condition has changed suddenly owing to the operation of the exhaust gas recirculation mechanism.

When the result in S100 is YES, the program proceeds to S102 in which the aforesaid (second) feedback correction coefficient KLAF based on the PID control law (PID controller) (hereinafter referred to as "PID correction coefficient") is calculated.

The PID correction coefficient KLAF is calculated as follows.

First, the control error DKAF between the desired air/fuel ratio KCMD and the detected air/fuel ratio KACT is calculated as:

$$DKAF(k)=KCMD(k-d')-KACT(k).$$

In this equation, KCMD(k−d') is the past desired air/fuel ratio (in which k indicates a sample number in the discrete time system and d' indicates the dead time before KCMD is reflected in KACT and thus signifies the desired air/fuel ratio before the dead time control cycle), and KACT(k) is the detected air/fuel ratio (in the current control (program) cycle). It should be noted that the desired value KCMD and the detected value KACT are in fact expressed as the equivalence ratio, namely, as Mst/M=1/lambda (Mst: stoichiometric air/fuel ratio, M=A/F (A: air mass flow rate, F: fuel mass flow rate), and lambda=excess air factor), so as to facilitate the calculation.

Next, the control error DKAF(k) is multiplied by specific coefficients to obtain control constants (gains), i.e., the P term KLAFP(k), I term KLAFI(k), and D term KLAFD(k) as $$P \text{ term: } KLAFP(k)=DKAF(k)\times KP$$

$$I \text{ term: } KLAFI(k)=KLAFI(k-1)+(DKAF(k)\times KI)$$

$$D \text{ term: } KLAFD(k)=(DKAF(k)-DKAF(k-1))\times KD.$$

Thus, the P term is calculated by multiplying the error by the proportional gain KP; the I term is calculated by adding the value of KLAFI(k−1), the feedback correction coefficient in the preceding control cycle (k−1), to the product of the error and the integral gain KI; and the D term is calculated by multiplying the difference between the value of DKAF(k), the error in the current control cycle, and the value of DKAF(k−1), the error in the preceding control cycle (k−1), by the differential gain KD. The gains KP, KI and KD are prepared as mapped data such that they are retrievable using the engine speed Ne and the manifold pressure Pb as address data. Finally, KLAF(k), the value of the feedback correction coefficient according to the PID control law in the current control cycle, is calculated by summing the thusobtained values:

$$KLAF(k)=KLAFP(k)+KLAFI(k)+KLAFD(k).$$

It should be noted here that KLAFI(k) includes an offset of 1.0 so that the value KLAF is a multiplicative correction coefficient. In other words, the initial value of KLAFI is set to be 1.0.

The program then moves to S104 of the subroutine of FIG. 6, in which the aforesaid feedback correction coefficient KSTR is determined using the adaptive control law. The feedback correction coefficient KSTR will hereinafter be referred to as the "adaptive correction coefficient".

Figure 5:
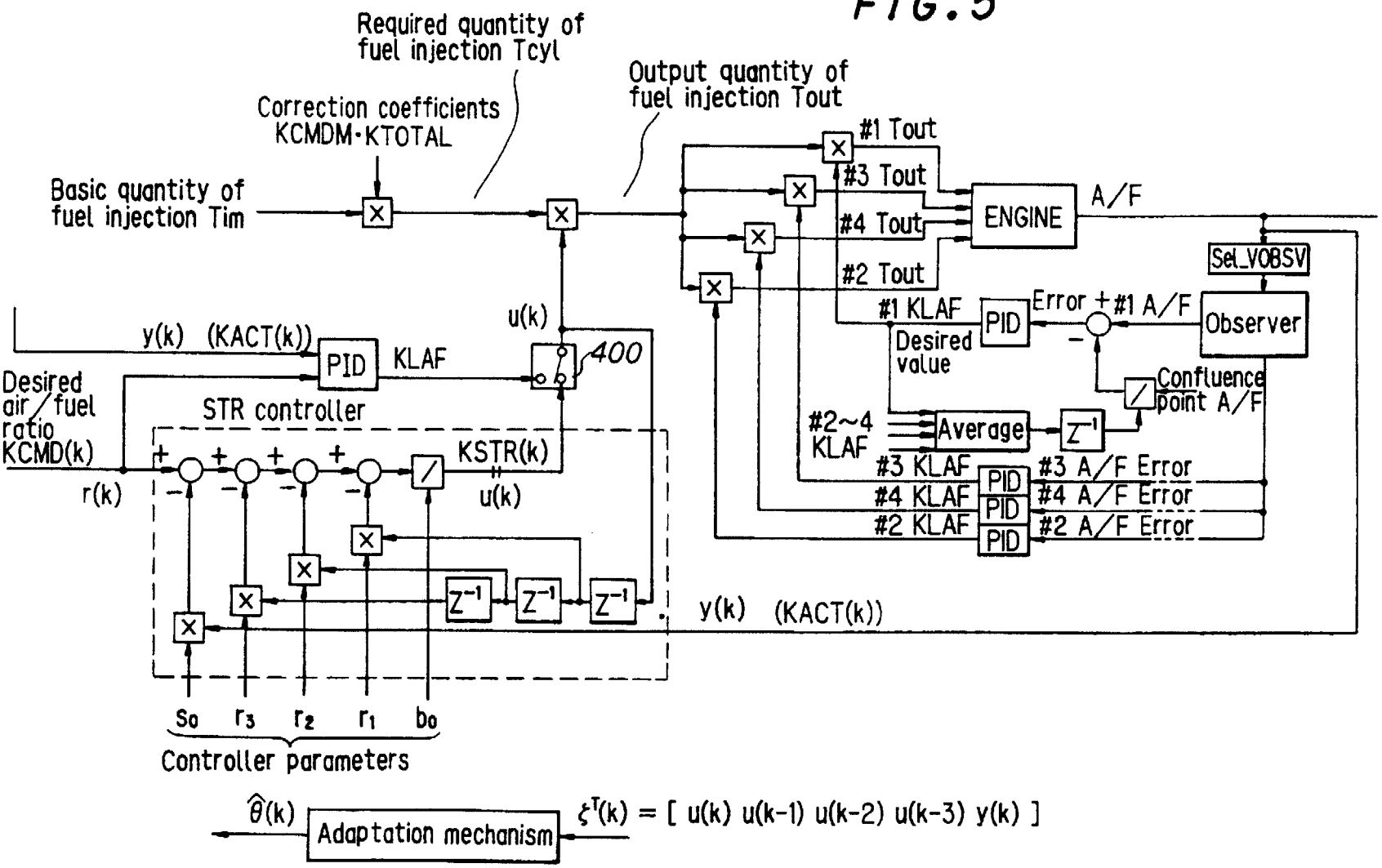
FIG. 5 is a block diagram showing the configuration of the system including a first to a third feedback loop.

Explaining this, the system illustrated in FIG. 5 is based on adaptive control technology proposed in an earlier application by the assignee. It comprises an adaptive controller constituted as an STR (self-tuning regulator) controller (controller means) and an adaptation mechanism (adaptation mechanism means) (system parameter estimator) for estimating/identifying the controller parameters (system parameters) $\hat{\theta}$. The desired value and the controlled variable (plant output) of the fuel metering feedback control system are input to the STR controller, which receives the coefficient vector (i.e., the controller parameters expressed in a vector) $\hat{\theta}$ estimated/identified by the adaptation mechanism, and generates an output.

One identification or adaptation law (algorithm) available for adaptive control is that proposed by I. D. Landau et al. In the adaptation law proposed by I.D. Landau et al., the stability of the adaptation law expressed in a recursion formula is ensured at least using Lyapunov's theory or Popov's hyperstability theory. This method is described in, for example, *Computrol*(Corona Publishing Co., Ltd.) No. 27, pp. 28–41; *Automatic Control Handbook*(Ohm Publishing Co., Ltd.) pp. 703–707; "A Survey of Model Reference Adaptive Techniques —Theory and Applications" by I.D. Landau in *Automatica*, Vol. 10, pp. 353–379, 1974; "Unification of Discrete Time Explicit Model Reference Adaptive Control Designs" by I. D. Landau et al. in *Automatica*, Vol. 17, No. 4, pp. 593–611, 1981; and "Combining Model Reference Adaptive Controllers and Stochastic Self-tuning Regulators" by I. D. Landau in *Automatica*, Vol. 18, No. 1, pp. 77–84, 1982.

The adaptation or identification algorithm of I. D. Landau et al. is used in the assignee's earlier proposed adaptive control technology. In this adaptation or identification algorithm, when the polynomials of the denominator and numerator of the transfer function $B(Z^{-1})/A(Z^{-1})$ of the discrete controlled system are defined in the manner of Eq. 1 and Eq. 2 shown below, then the controller parameters or system (adaptive) parameters $\hat{\theta}(k)$ are made up of parameters as shown in Eq. 3 and are expressed as a vector (transpose vector). And the input zeta (k) which is input to the adaptation mechanism becomes that shown by Eq. 4. Here, there is taken as an example a plant in which m =1, n =1 and d =3, namely, the plant model is given in the form of a linear system with three control cycles of dead time.

$$A(z^{-1})=1+a_1z^{-1}+\ldots+a_nz^{-n} \quad \text{Eq. 1}$$

$$B(z^{-1})=b_0+b_1z^{-1}+\ldots+b_mz^{-m} \quad \text{Eq. 2}$$

$$\begin{aligned}\hat{\theta}^T(k) &= |\hat{b}_0^{-1}(k), \hat{B}_R(z^{-1},k), \hat{S}(z^{-1},k)| \\ &= |\hat{b}_0(k), \hat{r}_1(k), \ldots, r_{m+d-1}(k), s_0(k), \ldots, s_{n-1}(k)| \\ &= |b_0(k), r_1(k), r_2(k), r_3(k), s_0(k)|\end{aligned} \quad \text{Eq. 3}$$

$$\begin{aligned}\zeta^T(k) &= |u(k), \ldots, u(k-m-d+1), y(k), \ldots, y(k-n+1)| \\ &= |u(k), u(k-1), u(k-2), u(k-3), y(k)|\end{aligned} \quad \text{Eq. 4}$$

Here, the factors of the controller parameters $\hat{\theta}$, i.e., the scalar quantity $\hat{b}_0^{-1}(k)$ that determines the gain, the control factor $\hat{B}_R(Z^{-1},k)$ that uses the manipulated variable and $\hat{S}(Z^{-1},k)$ that uses the controlled variable, all shown in Eq. 3, are expressed respectively as Eq. 5 to Eq. 7.

$$\hat{b}_0^{-1}(k)=1/b_0 \quad \text{Eq. 5}$$

$$\begin{aligned}\hat{B}_R(Z^{-1},k) &= r_1z^{-1}+r_2z^{-2}+\ldots+r_{m+d-1}z^{-(m+d-1)} \\ &= r_1z^{-1}+r_2z^{-2}+r_3z^{-3}\end{aligned} \quad \text{Eq. 6}$$

$$\begin{aligned}\hat{S}(Z^{-1},k) &= s_0+s_1z^{-1}+\ldots+s_{n-1}z^{-(n-1)} \\ &= s_0\end{aligned} \quad \text{Eq. 7}$$

As shown in Eq. 3, the adaptation mechanism estimates or identifies each coefficient of the scalar quantity and control factors, calculates the controller parameters (vector) $\hat{\theta}$ and supplies the controller parameters $\hat{\theta}$ to the STR controller. More specifically, the adaptation mechanism calculates the controller parameters $\hat{\theta}$ using the manipulated variable u(i) and the controlled variable y (j) of the plant (i,j include past values) such that the control error between the desired value and the controlled variable becomes zero.

More precisely, the controller parameters (vector) $\hat{\theta}(k)$ are calculated by Eq. 8 below. In Eq. 8, r(k) is a gain matrix (the (m+n+d)th order square matrix) that determines the estimation/identification rate or speed of the controller parameters $\hat{\theta}$, and e*(k) is a signal indicating the generalized estimation/identification error, i.e., an estimation error signal of the controller parameters. They are represented by recursion formulas such as those of Eqs. 9 and 10.

$$\hat{\theta}(k)=\hat{\theta}(k-1)+\Gamma(k-1)\zeta(k-d)e^*(k) \quad \text{Eq. 8}$$

$$\Gamma(k)=\frac{1}{\lambda_1(k)}\left[\Gamma(k-1)-\frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \quad \text{Eq. 9}$$

$$e^*(k)=\frac{D(z^{-1})y(k)-\hat{\theta}^T(k-1)\zeta(k-d)}{1+\zeta^T(k-d)\Gamma(k-1)\zeta(k-d)} \quad \text{Eq. 10}$$

Various specific algorithms are given depending on the selection of lambda 1(k) and lambda 2(k) in Eq. 9. lambda 1(k) =1, lambda 2(k) =lambda (0 <lambda <2) gives the gradually-decreasing gain algorithm (least-squares method when lambda =1); and lambda 1(k) =lambda 1 (0 <lambda 21 1), lambda 2(k) =lambda 2 (0 <lambda 2 <lambda) gives the variable-gain algorithm (weighted least-squares method when lambda 2 =1). Further, defining lambda 1(k)/lambda 2(k) =a and representing lambda 3(k) as in Eq. 11, the constant-trace algorithm is obtained by defining lambda 1(k)=lambda 3(k). Moreover, lambda 1(k)=1, lambda 2(k) =0 gives the constant-gain algorithm. As is clear from Eq. 9, in this case δ(k) =F(k−1), resulting in the constant value δ(k) =δ. Any of the algorithms are suitable for the time-varying plant such as the fuel metering control system according to the invention.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \quad \text{Eq. 11}$$

In the diagram of FIG. 5, the STR controller (adaptive controller) and the adaptation mechanism (system parameter estimator) are placed outside the system for calculating the quantity of fuel injection (fuel injection quantity determining means) and operate to calculate the feedback correction coefficient KSTR(k) so as to adaptively bring the detected value KACT(k) to the desired value KCMD(k–d') (where, as mentioned earlier, d' is the dead time before KCMD is reflected in KACT). In other words, the STR controller receives the coefficient vector O(k) adaptively estimated/identified by the adaptive mechanism and forms a feedback compensator (feedback control loop) so as to bring it to the desired value KCMD(k–d'). The basic quantity of fuel injection Tim is multiplied by the calculated feedback correction coefficient KSTR(k), and the corrected quantity of fuel injection is supplied to the controlled plant (internal combustion engine) as the output quantity of fuel injection Tout(k).

Thus, the feedback correction coefficient KSTR(k) and the detected air/fuel ratio KACT(k) are determined and input to the adaptation mechanism, which calculates/estimates the controller parameters (vector) $\hat{\theta}(k)$ that are in turn input to the STR controller. Based on these values, the STR controller uses the recursion formula to calculate the feedback correction coefficient KSTR(k) so as to bring the detected air/fuel ratio KACT(k) to the desired air/fuel ratio KCMD (k–d'). The feedback correction coefficient KSTR(k) is specifically calculated as shown by Eq. 12:

$$KSTR(k) = \frac{KCMD(k-d') - s_0 x y(k) - r_1 x KSTR(k-1) - r_2 x KSTR(k-2) - r_3 x KSTR(k-3)}{b_0} \quad \text{Eq. 12}$$

As explained in the foregoing, the detected value KACT (k) and the desired value KCMD(k) are also input to the PID controller, which calculates the PID correction coefficient KLAF(k) based on the PID control law as explained in connection with S102 of the flowchart of FIG. 6 so as to eliminate the control error between the detected value at the exhaust system confluence point and the desired value. One or the other of the feedback correction coefficient KSTR, obtained by the adaptive control law, and the PID correction coefficient KLAF, obtained using the PID control law, is selected to be used in determining the quantity of fuel injection by a switching mechanism 400 shown in FIG. 5.

Calculations are carried out in parallel in the STR controller and the PID controller. Specifically, the adaptation mechanism indicated by Eqs. 8 to 10 is input with internal or intermediate variables zeta (k–d)(a vector which lumps together the current and past values u(KSTR) and y(KACT) ), and calculates the controller parameters $\hat{\theta}(k)$ from the cause-and-effect relationship between the plant input u and the plant output y. Here, u is the aforesaid feedback correction coefficient KSTR or KLAF used in the fuel injection quantity calculation. When PID control, instead of adaptive control, is to be conducted in the next control cycle, the PID correction coefficient KLAF will be used as the feedback correction coefficient KFB.

Even if the input u(k) to the adaptation mechanism is changed from the coefficient KSTR(k) to KLAF(k), while conducting the PID control, the adaptation mechanism can calculate the controller parameters $\hat{\theta}$ properly, since the plant output (controlled variable, i.e., KACT(k+d') is generated in response to the feedback correction coefficient used for determining the manipulated variable so that the cause-and-effect relationship between the plant input and output is ensured. Thus, the adaptation mechanism can calculate the controller parameters $\hat{\theta}$ without causing the system to diverge. Therefore, inputting $\hat{\theta}(k)$ to Eq. 12 yields KSTR(k). The value KSTR(k) may be a value obtained by replacing KSTR(k–i)=KLAF(k–i) (i=1, 2, 3).

Thus, it will be apparent from the above that the adaptive correction coefficient KSTR can be calculated even when the PID controller is operating and that the PID correction coefficient KLAF and the adaptive correction coefficient KSTR will substantially be identical at any particular time during the parallel calculation. Since the values of the PID correction coefficient KLAF and the adaptive correction coefficient KSTR are almost identical, the switch between them is smooth.

Returning to the explanation of the FIG. 6 flowchart, the program moves to S106 in which the operating region is discriminated as to whether it is one in which the feedback control is to be conducted using the high control response feedback correction coefficient (adaptive correction coefficient KSTR) or using the low control response feedback correction coefficient (PID correction coefficient KLAF).

Figure 7:
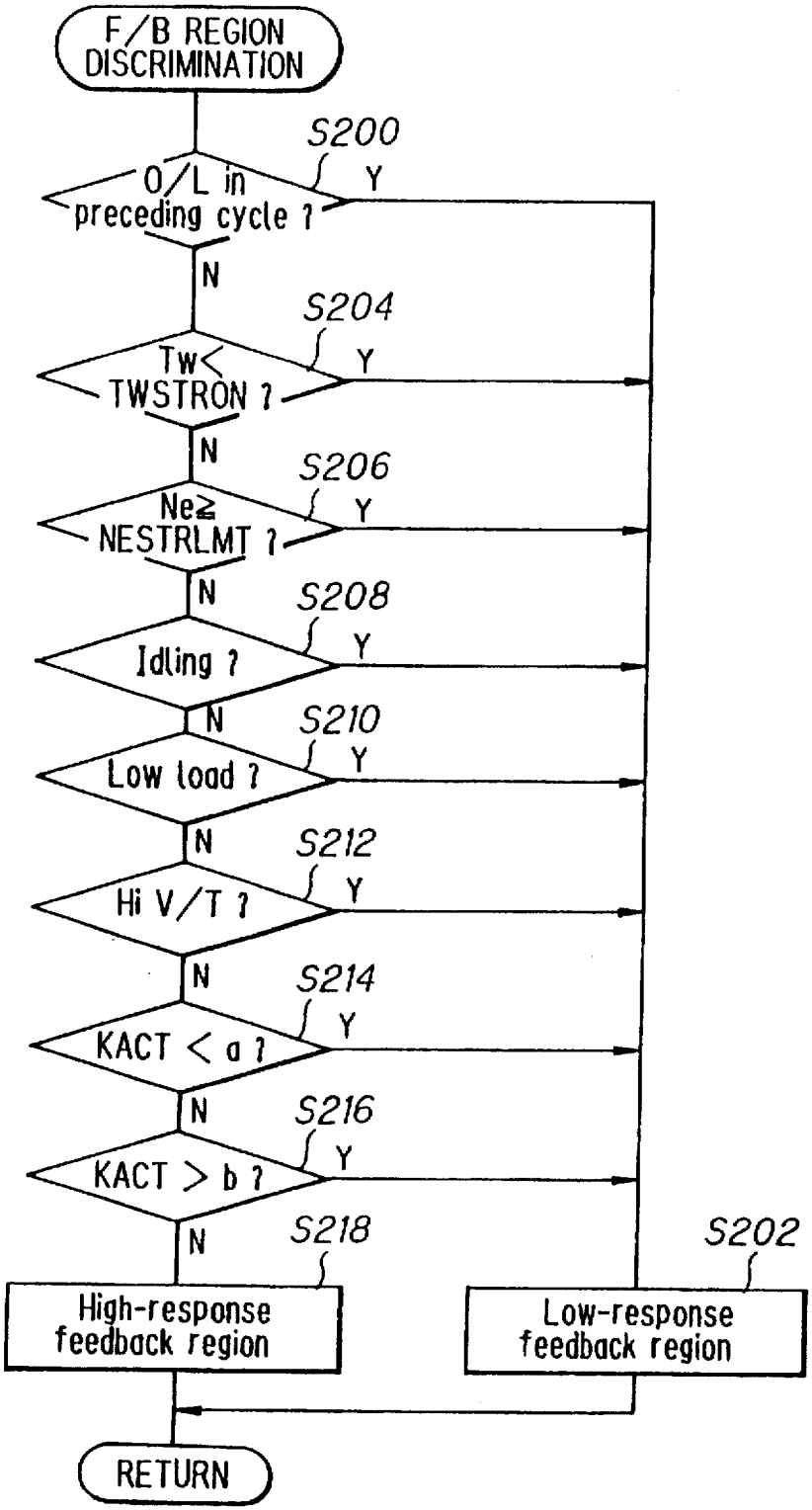
FIG. 7 is a subroutine flowchart of FIG. 6 showing the discrimination of the feedback control region referred to in FIG. 6.

FIG. 7 is the flowchart of a subroutine for this operating region discrimination.

First, in S200, it is checked whether openloop control was in effect at the preceding control cycle, i.e., at the time the routine of FIG. 4 was activated in the preceding control cycle (program loop). When the result is YES, the program goes to S202 in which the region is determined to be one in which feedback control is to be conducted using the low control response feedback correction coefficient (PID correction coefficient KLAF) (hereinafter referred to as the "low-response feedback region").

This is because, for the reason explained earlier, it is preferable not to conduct high response feedback control immediately after returning from open-loop control. In changing from open-loop control to feedback control it is possible to conduct low response feedback control for a prescribed period (5 TDCs, for example (TDC: Top Dead Center)). In such a case, a discrimination step will be inserted after S200 for continuously directing the program to S202 during the prescribed period.

When the result in S200 is NO, the program goes to S204 in which it is checked whether the engine coolant temperature Tw is less than a prescribed value TWSTRON. The prescribed value TWSTRON is set at a relatively low coolant temperature and when the detected engine coolant temperature Tw is below the prescribed value TWSTRON, the program proceeds to S202 in which the engine operating condition is determined to be in the low-response feedback region. The reason for this is the combustion is unstable at low coolant temperatures, making it impossible to obtain a stable detection of the value KACT owing to misfiring and the like. Although not shown in FIG. 7, for the same reason, the operating condition is also determined to be in the low-response feedback region when the coolant temperature is abnormally high.

When S204 finds that the engine coolant temperature Tw is not lower than the prescribed value TWSTRON, the program advances to S206 in which it is checked whether the detected engine speed Ne is at or above a prescribed value NESTRLMT. The prescribed value NESTRLMT is set at a relatively high engine speed. If S206 finds that the detected engine speed Ne is at or above the prescribed value NESTRLMT, the program goes to S202 in which the operating condition is determined to be in the low-response feedback region. This is because during high-speed engine operation there tends to be insufficient time for calculation and, moreover, combustion is unstable.

If S206 finds that the detected engine speed Ne is lower than the prescribed value NESTRLMT, the program proceeds to S208 in which it is checked whether the engine is idling. If the result is YES, the program goes to S202 in which the operating condition is determined to be in the low-response feedback region. This is because the generally stable operating condition during idling obviates the need for a high gain such as that according to the adaptive control law.

If S208 finds that the engine is not idling, the program proceeds to S210 in which it is judged whether the engine load is low. If the result is YES, the program goes to S202 in which the operating condition is determined to be in the low-response feedback region. This is because combustion is not stable in the low engine load region.

If S210 finds that the engine load is not low, the program proceeds to S212 in which it is checked whether HiV/T is selected in the variable valve timing mechanism and if so, to S202 in which the operating condition is determined to be in the low-response feedback region. This is because a large amount of valve timing overlap present when the high-engine-speed side valve timing characteristic is selected is apt to cause intake air blowby (escape of intake air through the exhaust valve), in which case the detected value KACT is not likely to be stable. In addition, the detection delay of the LAF sensor cannot be ignored during high-speed operation.

The decision as to whether or not high-speed side valve timing is selected is made not only based on whether or not high-speed valve timing (HiV/T) has actually been selected but also with reference to an appropriate flag indicating whether or not a command to switch the valve timing characteristics from the low-speed side (LoV/T) to the high-speed side has been issued in a control unit (not shown) of the variable valve timing mechanism.

This is because changes in valve timing characteristics may not be implemented at all cylinders simultaneously. During transient states and the like, therefore, cases may occur in which the valve timing characteristic temporarily differs between different cylinders. In other words, in switching the valve timing characteristic to the high-speed side, it is arranged so that the switch to the high-speed side is conducted in the control unit of the variable valve timing mechanism after confirmation that feedback control using the PID correction coefficient is in effect as a result of a discrimination that the engine operating condition is in the low-response feedback region.

When the result in S212 is NO, the program goes to S214 in which it is checked whether the detected air/fuel ratio KACT is below a prescribed value a. When the result is YES, the program goes to S202. If NO, it goes to S216 in which a check is made as to whether the detected value KACT is greater than a prescribed value b. When the result is YES, the program goes to S202. If NO, it goes to S218 in which the operating condition is determined to be in a region in which feedback control is to be conducted using a high control response feedback correction coefficient (adaptive correction coefficient KSTR) (hereinafter referred to as the "high-response feedback region"). The prescribed values a and b are appropriately set for enabling discrimination of lean and rich air/fuel ratios since it is better to avoid high response control such as adaptive control when the air/fuel ratio is lean or rich. In making the discrimination, the desired air/fuel ratio can be used in place of the detected air/fuel ratio for comparison with the prescribed values.

Returning to the subroutine of FIG. 6, it is then checked in S108 whether the region is determined to be the high-response feedback region. When the result is YES, the feedback correction coefficient KFB is set to or replaced with the adaptive feedback correction coefficient KSTR in S110, whereafter the I term KLAFI of the PID correction coefficient is set to or replaced with the feedback correction coefficient KFB in S112. The reason for this is that the I term (integral term) may change suddenly when the adaptive correction coefficient KSTR is switched to the PID correction coefficient KLAF in the next control cycle. By determining the initial value of the I term of the PID correction coefficient KLAF using the value of the adaptive correction coefficient KSTR in this way, the difference in level between the adaptive correction coefficient and the PID correction coefficient can be reduced to prevent sudden change in the manipulated variable and ensure stable control. Next, in S114, the bit of a flag FKSTR is set to 1 to indicate that the quantity of fuel injection is corrected using the adaptive correction coefficient KSTR.

On the other hand, when S108 finds that the operating condition is not in the high-response feedback region, the feedback correction coefficient KFB is set to the PID correction coefficient KLAF in S116 and the plant input u(k) is set to the feedback correction coefficient KFB in S118 (which will be input to the STR controller as shown in FIG. 5). This is because even outside the STR control region the STR controller continues to operate using the PID correction coefficient KLAF. The bit of the flag FKSTR is then reset to 0 in S120.

When S100 finds that the operating condition is not in the feedback region, the program goes to S122 in which it is checked whether a prescribed period has passed since leaving the feedback region. When the result is NO, the program goes to S124 where the value of KLAFI in the current control cycle is set to or replaced with KLAFI(k−1)(the value of the I term in the preceding control cycle), which is to say that the I term is held. Next, in S126, the internal or intermediate variables of the adaptive controller are similarly held at the preceding value, i.e., the final values during adaptive control.

Specifically, as shown in FIG. 5, the calculation of zeta(k) uses the plant input u, not only the input u(k) at the current control cycle but also u(k−1) and other past values of preceding control cycles. Therefore, i of u(k−i) in S126 is a comprehensive symbol encompassing the current and past control values. The procedure at S126 thus means that u(k), u(k−1), u(k−2) and u(k−3), more precisely, u(k−1), u(k−2), u(k−3) and u(k−4) are held. The controller parameters $\hat{\theta}$ and the gain matrix $\Gamma$ are simply held at their preceding values. In a case such as when the controller parameters $\hat{\theta}$ and the gain matrix $\Gamma$ are stored in memory as mapped values, the mapped data can be used in place of the held value. Further, though not shown in the drawings, KSTR and KACT are also held at the final values in adaptive control. KACT and u(k−i) can of course be lumped together and held as zeta.

Next, in S128, the value of the feedback correction coefficient KFB is set to 1.0, which is to say that feedback control is not conducted. The bit of the flag FKSTR is then reset to 0 in S130.

On the other hand, when S122 finds that the prescribed period has passed since leaving the feedback region, the value of the I term KLAFI is set to 1.0 (initial value) in S132, whereafter the plant input u, the controller parameters $\hat{\theta}$ and the gain matrix $\Gamma$ are set to prescribed values, e.g., their initial values in S134. The plant input u is specifically set to u(k)=u(k−1)=u(k−3)=1.

This is related to a frequently encountered situation. Namely, shortly after the accelerator pedal has once been released, fuel cutoff effected and open-loop control implemented, it often happens that the accelerator pedal is soon depressed again, causing the engine to accelerate and feedback control to be resumed. When feedback control is resumed after only a short time in this way, almost no change arises in the operating condition of the engine between before and after the non-operating region of the STR controller and, therefore, the cause-and-effect relationship with the combustion history naturally holds.

In the case of a transitory region of this kind, therefore, holding the internal variables of the adaptive controller improves the control stability by maintaining the continuity of the adaptive control and enabling the adaptive control to be conducted without unnecessarily returning to the initial state. In this sense, the prescribed period referred to regarding S122 defines a time range during which the cause-and-effect relationship with the combustion history continues to hold.

When the prescribed period or longer has passed, on the other hand, it can be assumed that a large change has occurred in the operating state of the engine between before and after the non-operating region of the STR controller. In this case, therefore, the I term of the PID correction coefficient is set to 1.0 in S132 and the internal variables are returned to prescribed values, for instance, their initial values, in S134. Initial values of $\hat{\theta}(k-1)$ and u(k) (=KSTR (k)) can be stored in memory for each operating region of the internal combustion engine and the stored values be used as the past values of $\hat{\theta}(k-1)$ and zeta (k–d ). This further improves control performance at resumption of adaptive control. In addition, $\hat{\theta}(k)$ can be learned for each operating region.

Returning to the FIG. 4 flowchart, the program proceeds to S16 in which it is checked whether the engine operating condition is in the feedback control region and if it is, to S18 in which the output of the LAF sensor is sampled at a predetermined timing to detect or determine the air/fuel ratio KACT(k). As stated before, the LAF sensor outputs are A/D converted once every predetermined crank angle and are stored in the buffers in the RAM 74. In this step, specifically, one from among the sampled data which is the best in the engine operating condition is selected by retrieving a timing map (whose characteristics are not shown) using the engine speed Ne, the manifold pressure Pb and the valve timing characteristics HiV/T, LoV/T currently in operation.

The characteristics of the timing map are established in such a manner that the sampling crank angle of the selected value becomes earlier with decreasing engine speed Ne and increasing manifold pressure (load) Pb. As regards the variable valve timing characteristics, the map characteristics are determined so that an earlier sampling point is selected at HiV/T than at LoV/T insofar as the engine speed and manifold pressure are the same. The block for processing this is shown as "Sel.VOBSV" in FIG. 5.

The program then proceeds to S20 in which the individual cylinder air/fuel ratios are obtained using the observer.

The air/fuel ratio estimation by the observer will here be explained briefly.

Figure 8:
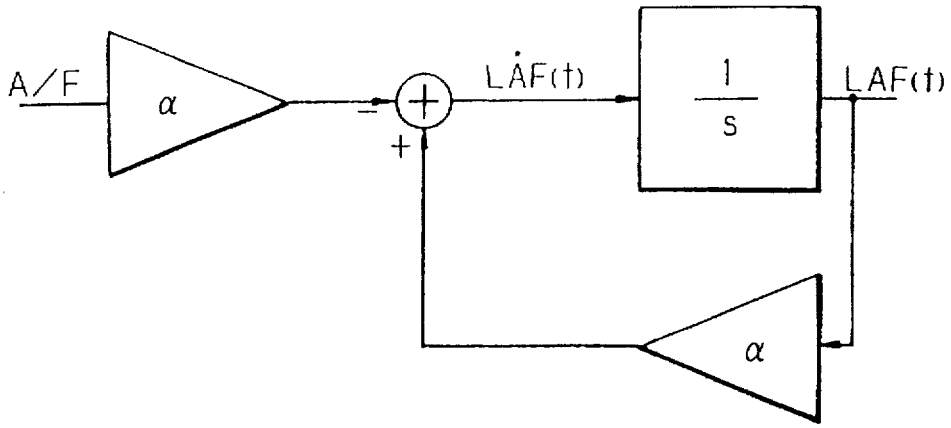
FIG. 8 is a block diagram showing a model proposed previously by the assignee which describes the detection behavior of the air/fuel ratio.

For high-accuracy separation and extraction of the air/fuel ratios of the individual cylinders from the output of a single LAF sensor, it is first necessary to accurately ascertain the detection response delay (lag time) of the LAF sensor. This delay was therefore modeled as a first-order delay system, to obtain the model shown in FIG. 8. Here, if we define LAF: LAF sensor output and A/F: input A/F, the state equation can be written as $$\dot{LAF}(t)=\alpha LAF(t)-\alpha A/F(t) \qquad \text{Eq. 13}$$

Discretizing this for period Delta T, yields $$LAF(k+1)=\hat{\alpha}LAF(k)+(1-\hat{\alpha})A/F(k) \qquad \text{Eq. 14}$$

Here, $\hat{\alpha}$ is the correction coefficient and is defined as:

$$\hat{\alpha}=1+\alpha\Delta T+(1/2!)\alpha^2\Delta T^2+(1/3!)\alpha^3\Delta T^3+(1/4!)\alpha^4 T^4$$

Figure 9:
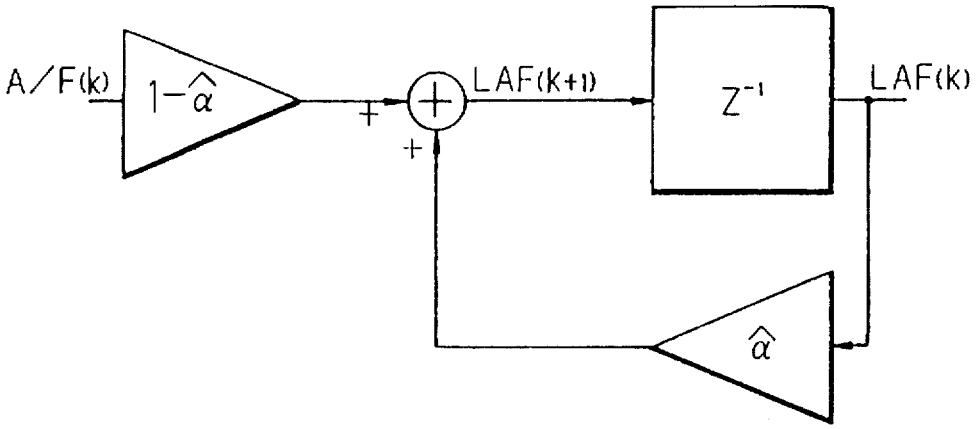
FIG. 9 is a block diagram which shows the model of FIG. 8 discretized in the discrete-time series for a period delta T.

Eq. 14 is represented as a block diagram in FIG. 9.

Therefore, Eq. 14 can be used to obtain the actual air/fuel ratio from the sensor output. That is to say, since Eq. 14 can be rewritten as Eq. 15, the value at time k–1 can be calculated back from the value at time k as shown by Eq. 16.

$$A/F(k)=\{LAF(k+1)-\hat{\alpha}LAF(k)\}/(1-\hat{\alpha}) \qquad \text{Eq. 15}$$

$$A/F(k-1)=\{LAF(k)-\hat{\alpha}LAF(k-1)\}/(1-\hat{\alpha}) \qquad \text{Eq. 16}$$

Figure 10:
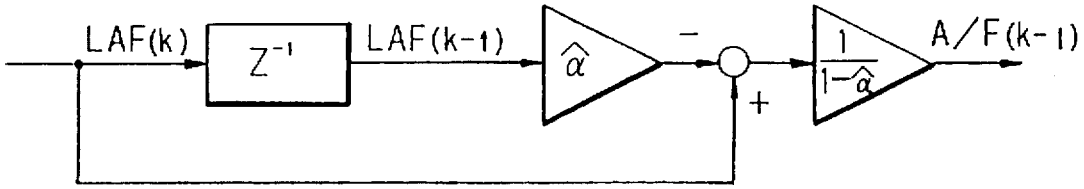
FIG. 10 is a block diagram showing a real-time air/fuel ratio estimator based on the model of FIG. 9.

Specifically, use of the Z transformation to express Eq. 14 as a transfer function gives Eq. 17, and a real-time estimate of the air/fuel ratio input in the preceding cycle can be obtained by multiplying the sensor output LAF of the current cycle by the reciprocal of this transfer function. FIG. 10 is a block diagram of the real-time A/F estimator.

$$\pi(z)=(1-\hat{\alpha})/(Z-\hat{\alpha}) \qquad \text{Eq. 17}$$

The separation and extraction of the air/fuel ratios of the individual cylinders using the actual air/fuel ratio obtained in the foregoing manner will now be explained. As explained in the earlier application, the air/fuel ratio at the exhaust system confluence point can be assumed to be an average weighted to reflect the time-based contribution of the air/fuel ratios of the individual cylinders. This makes it possible to express the air/fuel ratio at the confluence point at time k in the manner of Eq. 18. (As F (fuel) was selected as the controlled variable, the fuel/air ratio F/A is used here. For easier understanding, however, the air/fuel ratio will be used in the explanation so long as such usage does not lead to confusion. The term "air/fuel ratio" (or "fuel/air ratio") used herein is the actual value corrected for the response delay calculated according to Eq. 17.)

$$[F/A](k)=C_1[F/A\#_1]+C_2[F/A\#_3]+C_3[F/A\#_4]+C_4[F/A\#_2]$$

$$[F/A](k+1)=C_1[F/A\#_3]+C_2[F/A\#_4]+C_3[F/A\#_2]+C_4[F/A\#_1]$$

$$[F/A](k+2)=C_1[F/A\#_4]+C_2[F/A\#_2]+C_3[F/A\#_1]+C_4[F/A\#_3] \qquad \text{Eq. 18}$$

Figure 11:
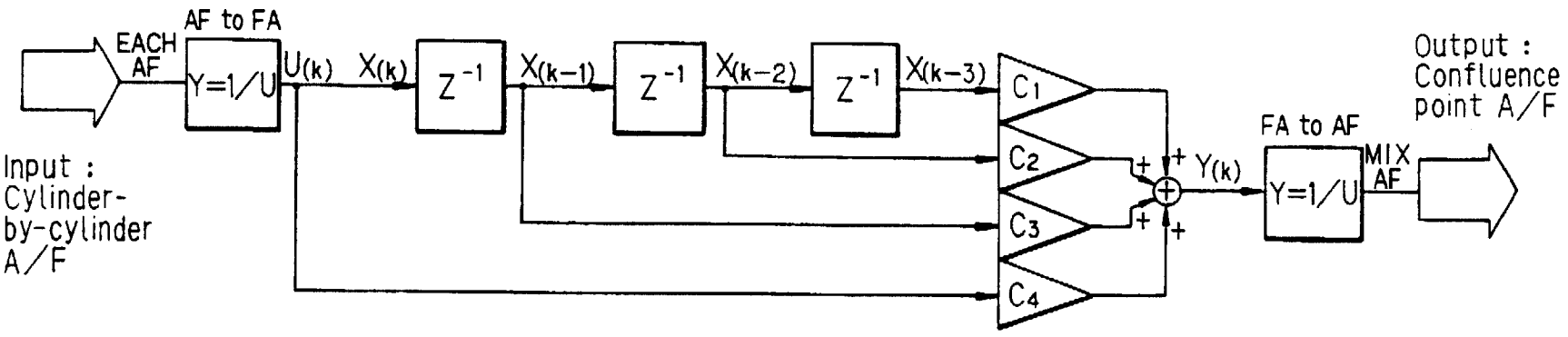
FIG. 11 is a block diagram showing a model proposed previously by the assignee which describes the behavior of the exhaust system of the engine.

More specifically, the air/fuel ratio at the confluence point can be expressed as the sum of the products of the past firing histories of the respective cylinders and weighting coefficient Cn (for example, 40% for the cylinder that fired most recently, 30% for the one before that, and so on). This model can be represented as a block diagram as shown FIG. 11.

Its state equation can be written as $$\begin{pmatrix} x(k-2) \\ x(k-1) \\ x(k) \end{pmatrix} = \begin{pmatrix} 010 \\ 001 \\ 000 \end{pmatrix} \begin{pmatrix} x(k-3) \\ x(k-2) \\ x(k-1) \end{pmatrix} + \begin{pmatrix} 0 \\ 0 \\ 1 \end{pmatrix} u(k) \qquad \text{Eq. 19}$$

Further, when the air/fuel ratio at the confluence point is defined as y(k), the output equation can be written as $$y(k) = [c_1\ c_2\ c_3]\begin{pmatrix} x(k-3) \\ x(k-2) \\ x(k-1) \end{pmatrix} + c_4 u(k) \quad \text{Eq. 20}$$

Here:

$c_1$:0.05, $c_2$:0.15, $c_3$:0.30, $c_4$:0.50

Since u(k) in this equation cannot be observed, even when an observer is designed from the equation, it will still not be possible to observe x(k). Thus, when one defines x(k+1)=x (k−3) on the assumption of a stable operating state in which there is no abrupt change in the air/fuel ratio from that of 4 TDCs earlier (i.e., from that of the same cylinder), Eq. 21 is obtained.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix}\begin{pmatrix} x(k-3) \\ x(k-2) \\ x(k-1) \\ x(k) \end{pmatrix} \quad \text{Eq. 21}$$

$$y(k) = [c_1 c_2 c_3 c_4]\begin{pmatrix} x(k-3) \\ x(k-2) \\ x(k-1) \\ x(k) \end{pmatrix}$$

Thus, the problem comes down to one of an ordinary Kalman filter in which x(k) is observed in the state equation (Eq. 22) and the output equation. When the weighting parameters Q, R are determined as Eq. 23 and Riccati's equation is solved, the gain matrix K becomes as shown in Eq. 24.

$$\begin{cases} X(k+1) = AX(k) + Bu(k) \\ y(k) = CX(k) + Du(k) \end{cases} \quad \text{Eq. 22}$$

Here:

$$A = \begin{pmatrix} 0100 \\ 0010 \\ 0001 \\ 1000 \end{pmatrix} C = [c_1 c_2 c_3 c_4] \quad B = D = [0] \quad \text{Eq. 23}$$

$$X(k) = \begin{pmatrix} x(k-3) \\ x(k-2) \\ x(k-1) \\ x(k) \end{pmatrix}$$

$$Q = \begin{pmatrix} 1000 \\ 0100 \\ 0010 \\ 0001 \end{pmatrix} R = [1]$$

$$K = \begin{pmatrix} 0.0436 \\ 0.2822 \\ 1.8283 \\ -0.2822 \end{pmatrix} \quad \text{Eq. 24}$$

Obtaining A-KC from this gives Eq. 25.

$$A - KC = \begin{pmatrix} -0.0022 & 0.9935 & -0.0131 & -0.0218 \\ -0.0141 & -0.0423 & 0.9153 & -0.1411 \\ -0.0914 & -0.2742 & -0.5485 & 0.0858 \\ 1.0141 & 0.0423 & 0.0847 & 0.1411 \end{pmatrix} \quad \text{Eq. 25}$$

Figure 12:
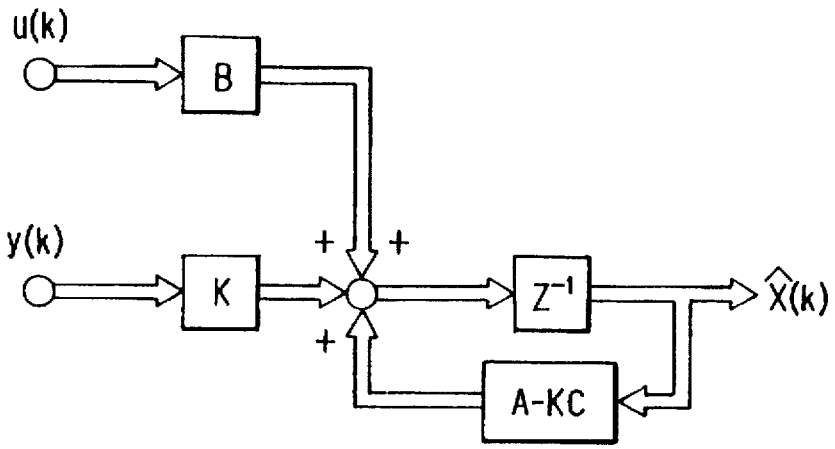
FIG. 12 is a block diagram showing the configuration of an ordinary observer.
Figure 13:
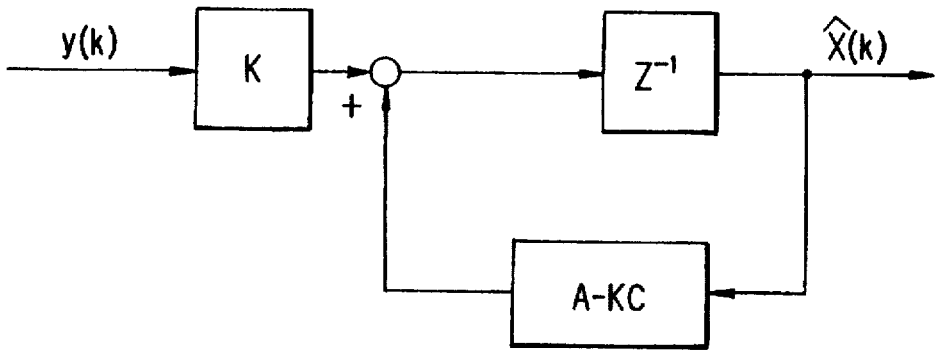
FIG. 13 is a block diagram which shows the configuration of the observer proposed previously by the assignee.

FIG. 12 shows the configuration of an ordinary observer. Since there is no input u(k) in the present model, however, the configuration has only y(k) as an input, as shown in FIG. 13. This is expressed mathematically by Eq. 26.

$$\begin{cases} \hat{X}(k+1) = [A - KC]\hat{X}(k) + Ky(k) \\ \hat{x}(k) = [0001]\hat{X}(k) \end{cases} \quad \text{Eq. 26}$$

The system matrix of the observer whose input is y(k), namely of the Kalman filter, is $$S = \left(\begin{array}{c|c} A - KC & K \\ \hline 0001 & 0 \end{array}\right) \quad \text{Eq. 27}$$

In the present model, when the ratio of the element of the weighting parameter R in Riccati's equation to the element of Q is 1:1, the system matrix S of the Kalman filter is given as $$S = \begin{pmatrix} -0.0022 & 0.9935 & -0.0131 & -0.0218 & 0.0436 \\ -0.0141 & -0.0423 & 0.9153 & -0.1411 & 0.2822 \\ -0.0914 & -0.2742 & -0.5485 & 0.0858 & 1.8283 \\ 1.0141 & 0.0423 & 0.0847 & 0.1411 & -0.2822 \\ 0.0000 & 0.0000 & 0.0000 & 1.0000 & 0.0000 \end{pmatrix} \quad \text{Eq. 28}$$

Figure 14:
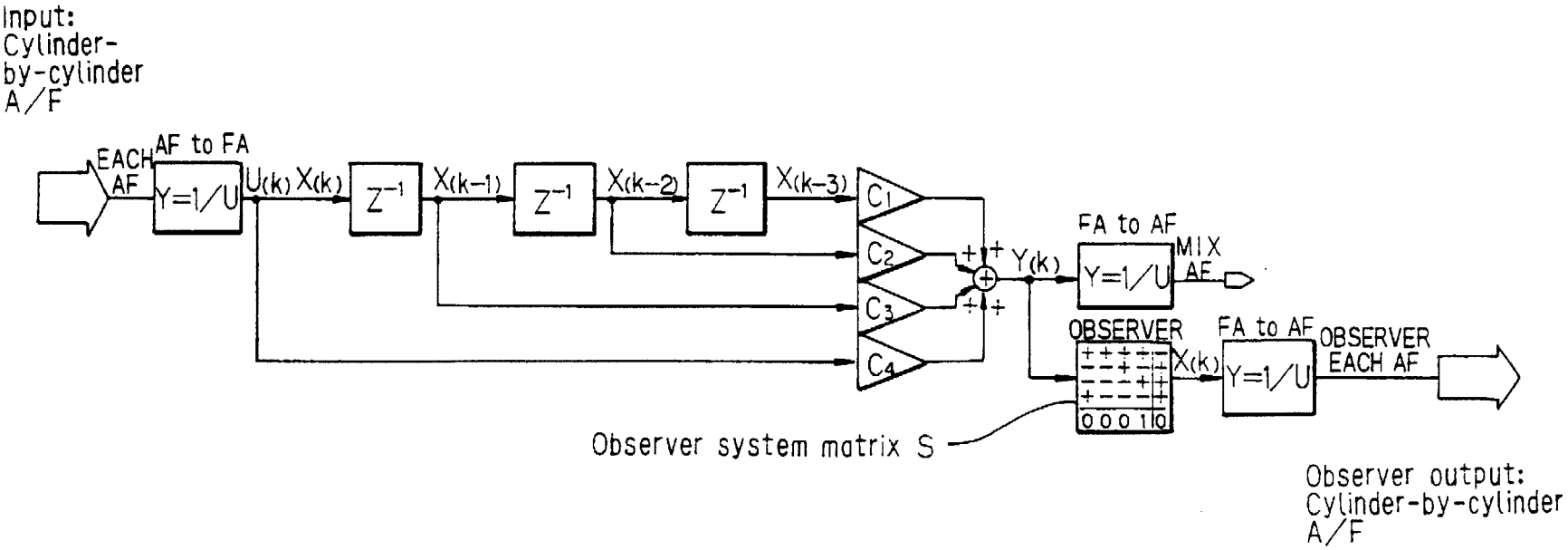
FIG. 14 is an explanatory block diagram showing the configuration achieved by combining the model of FIG. 11 and the observer of FIG. 13.

FIG. 14 shows the aforesaid model and observer combined. It suffices to say that this enables precise estimation of the air/fuel ratios at the individual cylinders from the air/fuel ratio of the confluence point.

Figure 15:
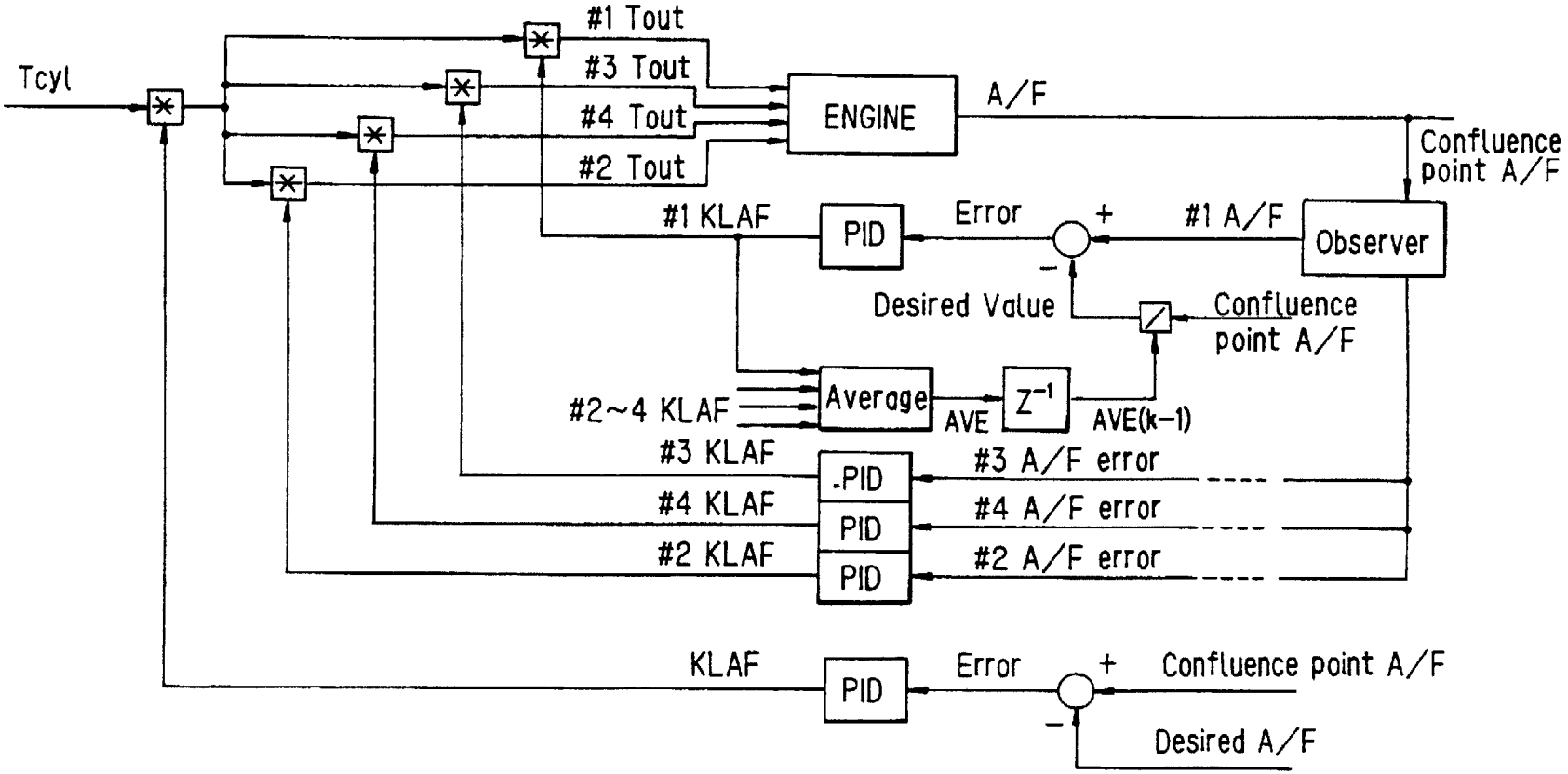
FIG. 15 is a block diagram showing the overall configuration of the second and the third air/fuel ratio feedback loops in the system.

Since the observer is able to estimate the individual air/fuel ratios from the air/fuel ratio at the confluence point, the air/fuel ratios of the individual cylinders can be separately controlled by PID control or the like. Specifically, as illustrated in FIG. 15, in which the feedback section of the observer of FIG. 13 is extracted and shown by itself, a confluence point feedback correction coefficient KLAF is calculated from the LAF sensor output (confluence point air/fuel ratio) and the desired air/fuel ratio KCMD using the PID control law, and cylinder-by-cylinder feedback correction coefficients #nKLAF (n: cylinder concerned) are calculated from the observer's estimated air/fuel ratio #nA/F.

More specifically, the individual cylinders (cylinder-by-cylinder) feedback correction coefficient #nKLAF are obtained by using the PID law to eliminate the error between the observer's estimated air/fuel ratios #nA/F and the desired value obtained by dividing the confluence point air/fuel ratio by the average value of the cylinder-by-cylinder feedback correction coefficients #nKLAF calculated in the preceding cycle.

Owing to this, the air/fuel ratios of the individual cylinders converge to the confluence point air/fuel ratio and the confluence point air/fuel ratio converges to the desired air/fuel ratio and as a result, the air/fuel ratios of all cylinders converge to the desired air/fuel ratio. The output quantity of fuel injection #nTout (n: cylinder concerned) is determined by the fuel injector opening period and can be calculated as $$\#nTout = Tcyl \times \#nKLAF \times KLAF.$$

Here, Tcyl: required quantity of fuel injection.

In the above, the calculation of the feedback correction coefficient #nKLAF for each cylinder is similar to the feedback correction coefficient KLAF. Specifically, the control error DKAF between the desired air/fuel ratio KCMD and each cylinder air/fuel ratio #nA/F estimated by the observer based on the detected air/fuel ratio KACT is first obtained, and then the control error DKAF is multiplied by specific coefficients to obtain control constants (gains), i.e., the P (proportional) term #nKLAFP(k), I (integral) term #nKLAFI(k), and D (differential or derivative) term #nKLAFD(k) as:

$P$ term: $\#nKLAFP(k)=DKAF(k)\times KP$ $I$ term: $\#nKLAFI(k)=\#nKLAFI(k-1)+(DKAF(k)\times KI)$ $D$ term: $\#nKLAFD(k)=(DKAF(k)-DKAF(k-1))\times KD.$ Finally, #nKLAF(k) in the current control cycle is calculated by summing the thus-obtained values.

Similarly to the coefficient KLAF, the gains KP, KI and KD are prepared in advance or preestablished as mapped data retrievable using the engine speed and the engine load as address data. The mapped data are prepared respectively for the coefficients KSTR and KLAF, as will be referred to just below.

Based on the above, again returning to the explanation of FIG. 4, the program proceeds to S22 in which it is checked or discriminated whether the bit of the flag FKSTR is set to ON, in other words, it is checked whether the adaptive correction coefficient KSTR should be used. When the result is affirmative, the program proceeds to S24 in which the control constants (KP, KI and KD gains) of the coefficient #nKLAF for the high response feedback correction coefficient (adaptive correction coefficient KSTR) are retrieved by the engine speed and the engine load. On the other hand, when it is found or discriminated in S22 that the low response coefficient (PID correction coefficient KLAF) is selected, the program goes to S26 in which the control constants for low response are similarly retrieved.

Figure 16A:
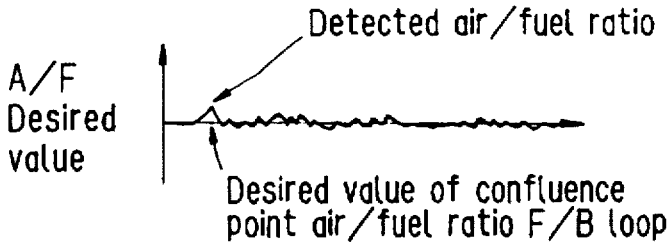
FIG. 16(*a*) and 16(*b*) are timing charts showing the detected air/fuel ratio, etc., when an adaptive correction coefficient is used.
Figure 16B:
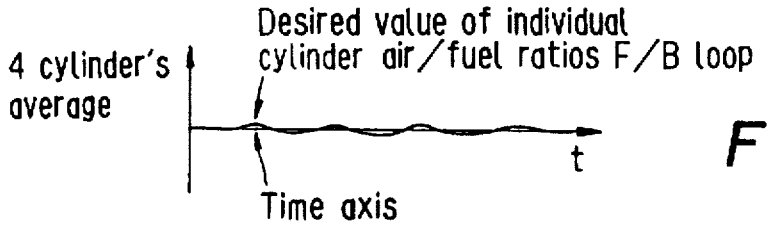
Figure 17A:
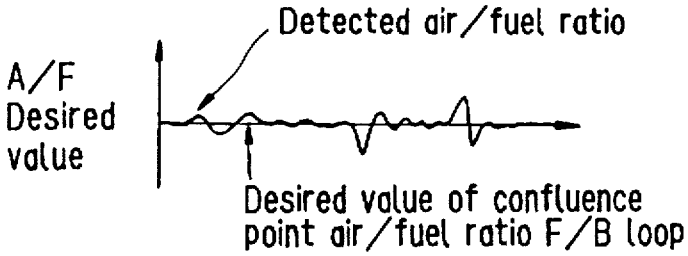
FIG. 17(*a*) and 17(*b*) are views, similar to FIG. 16(*a*) and 16(*b*), but showing the case when a PID correction coefficient is used.
Figure 17B:
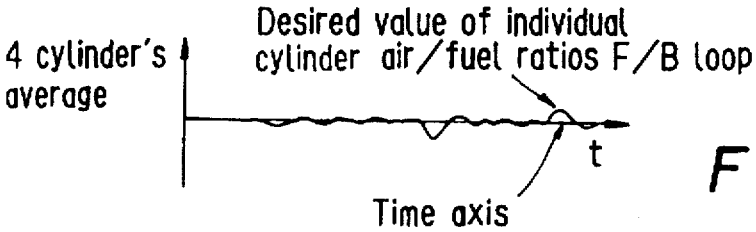

Explaining this, since the coefficient KSTR is higher in control response than the coefficient KLAF, the coefficient KSTR is better in control convergence to the desired value. As mentioned before, the desired value of the individual cylinders feedback control is obtained based on the average value in the individual cylinder air/fuel ratios, i.e., is obtained by dividing KACT by an average of #nKLAFs in the individual cylinders at the previous control cycle. FIG. 16(*a*) is a timing chart which shows the detected air/fuel ratio when the adaptive correction coefficient KSTR is used. The desired value of the individual cylinder air/fuel ratios feedback (control) loop at that time is as shown in FIG. 16(*b*). On the other hand, FIG. 17(*a*) and 17(*b*) are timing charts which illustrate the case when the PID correction coefficient KLAF is used. As seen from the figures, when the coefficient KLAF is used, the desired value of the individual cylinder air/fuel ratios feedback (control) loop fluctuates more greatly than in the case when KSTR is used.

In the embodiment, the system is configured such that the confluence point air/fuel ratio feedback and the individual cylinder air/fuel ratios feedback are arranged in series as double loops. Since the response from the fuel supply to the detected air/fuel ratio varies in every engine operating region, the response of the engine or the feedback loop similarly changes in each engine operating region.

Since the adaptive correction coefficient KSTR is higher than the PID correction coefficient KLAF in response, it can be considered that the #nKLAF gains should preferably be increased when the coefficient KSTR is used than when the coefficient KLAF is used. This is because, since the desired value of the individual cylinder air/fuel ratios feedback loop is kept stable by the coefficient KSTR, it is possible to enhance control convergence by raising the #nKLAF gains. Saying this in other words, since the control response is relatively low when the PID correction coefficient KLAF is used, the #nKLAF gains should preferably be lowered. For another reason, when the coefficient KLAF is used, since the desired value of the individual cylinder air/fuel ratios feedback control is kept less stable when compared with that conducted by using the coefficient KSTR, it is considered to be better not to raise the gain of the coefficient #nKLAF, provided that the relationship between the detected air/fuel ratio and the desired air/fuel ratio of the individual cylinder air/fuel ratios feedback control loop is as illustrated in FIGS. 16(*a*) and 17(*a*)–17(*b*)

Generally speaking, when the response in a feedback loop is raised too high, the system is apt to oscillate. Taking this into account, it can be considered, on the contrary, that the #nKLAF gains should preferably be lowered when the coefficient KSTR is used, than in the case when the coefficient KLAF is used. This will be advantageous in preventing the feedback system from oscillating, since the gain of the feedback system is, when viewed in total, too high. On the other hand, it may be considered that, when the control is conducted using the coefficient KLAF, if the #nKLAF gains are raised, the gain of the feedback system in the double loop would not be so high, keeping the system stable.

The above discussions would be different when the engine is at a high engine speed under high load or when the engine is under low load, especially in idling. This means that, when the coefficient KSTR or KLAF remains unchanged, the coefficient #nKLAF gains should be raised or lowered in response to the engine speed and engine load. This will be ascertained by experimentation.

In view of the above, the embodiment is configured such that mapped data of the gains KP, KI and KD are respectively predetermined for the coefficients KSTR and KLAF of the confluence point air/fuel ratio feedback loop, as explained before, and that the gains are retrieved from the mapped data using the engine speed and engine load as address data in response to the selected coefficient of KSTR or KLAF. More specifically, the response of the individual cylinder air/fuel ratios feedback correction coefficient #nKLAF is configured to be varied in order to enhance the control stability as much as possible. Although two sets of mapped data are prepared respectively, it is instead possible to prepare only one set of mapped data and to correct retrieved values by the coefficient selected.

Returning to the explanation of FIG. 4, when it has been determined in S22 that the adaptive correction coefficient KSTR is selected as the feedback correction coefficient KFB, and the mapped data has been retrieved in response to the selected coefficient KSTR in S24, the program proceeds to S28 in which the feedback correction coefficient #nKLAF is calculated for the cylinder concerned based on the map retrieval data in the manner mentioned before.

On the other hand, when S22 finds that the PID correction coefficient KLAF has been selected and the mapped data corresponding thereto are retrieved in S26, the program goes to S30 in which the coefficient #nKLAF is similarly calculated, and to S32 in which a learning control value #nKLAPSTY is calculated. This is done by, for example, calculating a weighted average of the values at the current control cycle #nKLAF(k) (current program loop) and at the previous control cycle #nKLAF(k−1) (previous program loop). This value will be used in the open-loop control as will be explained later. The reason why this step is placed after, not S28, but S30 is that the coefficient #nKLAF calculated when the low response coefficient KLAF is used will be better in use in the open-loop control.

The program then proceeds to S34 in which basic quantity of fuel injection Tim is multiplied by a correction coefficient KCMDM (a value determined by correcting the desired air/fuel ratio KCMD (expressed in equivalence ratio) by the charging efficiency of the intake air), and a product of the various correction coefficients KTOTAL to determine the required quantity of fuel injection Tcyl(k), to S36 in which the required quantity of fuel injection Tcyl(k) is multiplied by the confluence point air/fuel ratio feedback correction coefficient KFB and the individual cylinder air/fuel ratios feedback correction coefficient #nKLAF(k) to determine the output quantity of fuel injection #nTout(k) for the cylinder concerned, and to S38 in which the output quantity of fuel injection #nTout(k) for the cylinder concerned is applied to the fuel injector 22 as the manipulated variable.

Here, KTOTAL is the product of various correction coefficients to be made through multiplication including correction based on the coolant temperature correction. Although not shown, a sum of additive correction TTOTAL that indicates the total value of the various corrections for atmospheric pressure, etc., conducted by addition, will be added. Moreover, the fuel injector dead time, etc., will be added separately at the time of outputting the output quantity of fuel injection #nTout(k).

When the result in S16 is negative, the fuel metering control is conducted in the open-loop manner and the program proceeds to S40 in which the learning control value #nKLAFSTY is used as the coefficient #nKLAF, and to S34 in which the required quantity of fuel injection Tcyl(k) is calculated. When S12 finds that the engine is cranking, the program goes to S42 in which the quantity of fuel injection at cranking Ticr is retrieved and to S44 in which the output quantity of fuel injection #nTout(k) is calculated based on the retrieved value in accordance with a start mode equation using Ticr.

Configured in the foregoing manner, the embodiment can decrease air/fuel variance among the cylinders by using the individual cylinder air/fuel ratios feedback correction coefficient #nKLAF. Moreover, since the control constants (gains) of the coefficient #nKLAF are determined in response to the confluence point air/fuel ratio feedback correction coefficient KFB, the control stability can be enhanced.

Furthermore, when the fuel metering control is switched to the feedback control upon the termination of the open-loop control, such as in the case of returning from the fuel cutoff, the feedback control is conducted using the PID correction coefficient for a predetermined period. This can prevent the controlled variable from becoming unstable and therefore the control stability from degrading. By the feedback correction coefficient calculated based on the high control response adaptive controller, on the other hand, when the detected air/fuel ratio becomes stable, the control error between the desired air/fuel ratio and the detected exhaust air/fuel ratio can then be decreased to zero or converged at one time.

In addition, since the STR controller and the PID controller are operated in parallel while mutually replacing the internal or intermediate variables so as to calculate the adaptive correction coefficient KSTR and the PID correction coefficient KLAF in parallel, the transition from the adaptive correction coefficient KSTR to the PID correction coefficient KLAF and vice versa can be smoothly conducted, with a desired timing, resulting in improved fuel metering control performance.

Although a PID control is taken as an example in the embodiment, it is permissible instead to appropriately set the KP, KI and KD gains for conducting PI control and to control only the I term. In other words, the PID control referred to in the specification is established insofar as it includes some of the gain terms.

Although the air/fuel ratio, more precisely the equivalence ratio, is used as the desired value in the embodiment, the quantity of fuel injection can instead be used as the desired value.

Although the adaptive correction coefficients KSTR and KLAF are calculated as multiplication coefficients (terms) in the embodiment, they can instead be calculated as addition terms.

Although a throttle valve is operated by the stepper motor in the first and second embodiments, it can instead be mechanically linked with the accelerator pedal and be directly operated in response to the accelerator depression.

Furthermore, although the aforesaid embodiments are described with respect to examples using STR, MRACS (model reference adaptive control systems) can be used instead.

Furthermore, the invention is not limited to the arrangement and can instead be configured to have air/fuel ratio sensors (LAF sensors) disposed in the exhaust system in a number equal to the number of cylinders so as to detect the air/fuel ratios in the individual cylinders based on the outputs of the individual cylinders.

Although the invention has thus been shown and described with reference to the specific embodiments, it should be noted that the invention is in no way limited to the details of the described arrangements, changes and modifications may be made without departing from the scope of the appended claims.

What is claimed is:

1. A system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a quantity of fuel injection for a cylinder of the engine based on at least the detected engine operating conditions;

a first feedback loop means having a first controller means for calculating a first feedback correction coefficient, using a control law expressed in a recursion formula, to correct the quantity of fuel injection, such that a controlled variable obtained based on at least the detected air/fuel ratio detected by said air/fuel ratio sensor is brought to a desired value;

a second feedback loop means having a second controller means for calculating a second feedback correction coefficient, using a control law whose control response is less than that of the first control law, to correct the quantity of fuel injection such that the controlled variable is brought to the desired value;

a third feedback loop means having a third controller means for calculating a third feedback correction coefficient using a control constant, to correct the quantity of fuel injection for individual cylinders, such that air/fuel ratio variance among the cylinders decreases;

selecting means for selecting one of the first feedback correction coefficient and the second feedback correction coefficient in response to the detected engine operating conditions;

output fuel injection quantity determining means operatively coupled to said fuel injection quantity determining means, said first feedback loop means, said second feedback loop means, and said third feedback loop means, for correcting the quantity of fuel injection based on the selected feedback correction coefficient and the third feedback correction coefficient to determine an output quantity of fuel injection; and a fuel injector means operatively coupled to said output fuel injection quantity determining means, for injecting fuel in the cylinder of the engine based on the determined output quantity of fuel injection;

wherein:

coefficient discriminating means are operatively coupled to said selecting means for discriminating which of the first feedback correction coefficient and the second feedback correction coefficient is selected; and said third controller means determines the control constant to calculate the third feedback correction coefficient based on the selected feedback correction coefficient.

2. A system according to claim 1, further including individual cylinder air/fuel ratios estimating means comprising:

a model means describing behavior of the exhaust system of the engine operatively coupled to the output of said air/fuel ratio sensor;

observer means operatively coupled to said model means, for observing an internal state of the exhaust system described by said model means; and estimating means operatively coupled to said observer means, for estimating the air/fuel ratios of the individual cylinders based on an output of said observer means; and said third controller means determines the control constant based on the estimated air/fuel ratios of the individual cylinders to calculate the third feedback correction coefficient.

3. A system according to claim 2, further including:

control constant establishing means for establishing the control constant with respect to the engine operating conditions for the first feedback correction coefficient and the second feedback correction coefficient; and said third controller means determines the control constant based on the selected feedback correction coefficient in response to the detected engine operating conditions.

4. A system according to claim 2, wherein the third controller is a PID controller and the control constant is at least one of a P gain, an I gain and a D gain.

5. A system according to claim 2, further including:

learning control means for calculating a learning control value of the third feedback correction coefficient;

and said output quantity fuel injection determining means uses the learning control value, when engine operation is not in a feedback control region.

6. A system according to claim 2, wherein the control law expressed in a recursion formula is an adaptive control law.

7. A system according to claim 1, further including:

control constant establishing means for establishing the control constant with respect to the engine operating conditions for the first feedback correction coefficient and the second feedback correction coefficient; and said third controller means determines the control constant based on the selected feedback correction coefficient in response to the detected engine operating conditions.

8. A system according to claim 7, wherein the third controller is a PID controller and the control constant is at least one of a P gain, an I gain and a D gain.

9. A system according to claim 7, further including:

learning control means for calculating a learning control value of the third feedback correction coefficient;

and said output quantity fuel injection determining means uses the learning control value when engine operation is not in a feedback control region.

10. A system according to claim 7, wherein the control law expressed in a recursion formula is an adaptive control law.

11. A system according to claim 7, wherein said first feedback loop means has an adaptive controller and an adaptation mechanism coupled to said adaptive controller for estimating controller parameters, said first controller calculating said first feedback correction coefficient using internal variables that include at least said controller parameters.

12. A system according to claim 7, wherein the feedback correction coefficient is multiplied by the basic quantity of fuel injection.

13. A system according to claim 1, wherein the third controller is a PID controller and the control constant is at least one of a P gain, an I gain and a D gain.

14. A system according to claim 13, further including:

learning control means for calculating a learning control value of the third feedback correction coefficient; and said output quantity fuel injection determining means uses the learning control value when engine operation is not in a feedback control region.

15. A system according to claim 13, wherein the control law expressed in a recursion formula is an adaptive control law.

16. A system according to claim 13, wherein said first feedback loop means has an adaptive controller and an adaptation mechanism coupled to said adaptive controller for estimating controller parameters, said first controller calculating said first feedback correction coefficient using internal variables that include at least said controller parameters.

17. A system according to claim 1, further including:

learning control means for calculating a learning control value of the third feedback correction coefficient; and said output quantity fuel injection determining means uses the learning control value when engine operation is not in a feedback control region.

18. A system according to claim 17, wherein the control law expressed in a recursion formula is an adaptive control law.

19. A system according to claim 1, wherein the control law expressed in a recursion formula is an adaptive control law.

20. A system according to claim 1, wherein said first feedback loop means has an adaptive controller and an adaptation mechanism coupled to said adaptive controller for estimating controller parameters, said first controller calculating said first feedback correction coefficient using internal variables that include at least said controller parameters.

21. A system according to claim 1, wherein the feedback correction coefficient is multiplied by the basic quantity of fuel injection.

22. A computer program controlled system for controlling fuel metering for an internal combustion engine having a plurality of cylinders and an exhaust system, said system comprising:

an air/fuel ratio sensor installed in said exhaust system of the engine for detecting an air/fuel ratio of the engine;

engine operating condition detecting means for detecting engine operating conditions including at least engine speed and engine load;

fuel injection quantity determining means, operatively coupled to said engine operating condition detecting means, for determining a quantity of fuel injection for a cylinder of the engine based on at least the detected engine operating conditions;

a first feedback loop means having a first controller means for calculating a first feedback correction coefficient, using a control law expressed in a recursion formula, to correct the quantity of fuel injection, such that a controlled variable obtained based on at least the detected air/fuel ratio detected by said air/fuel ratio sensor is brought to a desired value;

a second feedback loop means having a second controller means for calculating a second feedback correction coefficient, using a control law whose control response is less than that of the first control law, to correct the quantity of fuel injection such that the controlled variable is brought to the desired value;

a third feedback loop means having a third controller means for calculating a third feedback correction coefficient using a control constant, to correct the quantity of fuel injection for individual cylinders, such that air/fuel ratio variance among the cylinders decreases;

selecting means for selecting one of the first feedback correction coefficient and the second feedback correction coefficient in response to the detected engine operating conditions;

output fuel injection quantity determining means operatively coupled to said fuel injection quantity determining means, said first feedback loop means, said second feedback loop means, and said third feedback loop means, for correcting the quantity of fuel injection based on the selected feedback correction coefficient and the third feedback correction coefficient to determine an output quantity of fuel injection; and a fuel injector means operatively coupled to said output fuel injection quantity determining means, for injecting fuel in the cylinder of the engine based on the determined output quantity of fuel injection;

wherein:

coefficient discriminating means being operatively coupled to said selecting means for discriminating which of the first feedback correction coefficient and the second feedback correction coefficient is selected; and said third controller means determining the control constant to calculate the third feedback correction coefficient based on the selected feedback correction coefficient.

23. A computer program controlled system according to claim 22, further including individual cylinder air/fuel ratios estimating means comprising:

a model means describing behavior of the exhaust system of the engine operatively coupled to the output of said air/fuel ratio sensor;

observer means operatively coupled to said model means, for observing an internal state of the exhaust system described by said model means; and estimating means operatively coupled to said observer means, for estimating the air/fuel ratios of the individual cylinders based on an output of said observer means; and said third controller means determines the control constant based on the estimated air/fuel ratios of the individual cylinders to calculate the third feedback correction coefficient.

24. A computer program controlled system according to claim 22, further including:

control constant establishing means for establishing the control constant with respect to the engine operating condition for the first feedback correction coefficient and the second feedback correction coefficient; and said third controller means determines the control constant based on the selected feedback correction coefficient in response to the detected engine operating conditions.

25. A computer program controlled system according to claim 22, wherein the third controller is a PID controller and the control constant is at least one of a P gain, an I gain and a D gain.

26. A computer program controlled system according to claim 22, further including:

learning control means for calculating a learning control value of the third feedback correction coefficient; and said output quantity fuel injection determining means uses the learning control value when engine operation is not in a feedback control region.

27. A computer program controlled system according to claim 22, wherein the control law expressed in a recursion formula is an adaptive control law.

28. A system according to claim 22, wherein the feedback correction coefficient is multiplied by the basic quantity of fuel injection.

29. A method for controlling fuel metering for an internal combustion engine having a plurality of cylinders and an exhaust system, said method comprising the steps of:

detecting an air/fuel ratio of the engine;

detecting engine operating conditions including at least engine speed and engine load;

determining a quantity of fuel injection for a cylinder of the engine based on at least the detected engine operating conditions;

calculating a first feedback correction coefficient, using a control law expressed in a recursion formula, to correct the quantity of fuel injection, such that a controlled variable obtained based on at least the detected air/fuel ratio is brought to a desired value;

calculating a second feedback correction coefficient, using a control law whose control response is less than that of the first control law, to correct the quantity of fuel injection such that the controlled variable is brought to the desired value;

calculating a third feedback correction coefficient using a control constant, to correct the quantity of fuel injection for individual cylinders, such that air/fuel ratio variance among the cylinders decreases;

selecting one of the first feedback correction coefficient and the second feedback correction coefficient in response to the detected engine operating conditions;

correcting the quantity of fuel injection based on the selected feedback correction coefficient and the third feedback correction coefficient to determine an output quantity of fuel injection; and injecting fuel in the cylinder of the engine based on the determined output quantity of fuel injection;

wherein:

discriminating which of the first feedback correction coefficient and the second feedback correction coefficient is selected; and determining the control constant to calculate the third feedback correction coefficient based on the selected feedback correction coefficient.

30. A method according to claim 29, further including estimating individual cylinder air/fuel ratios comprising the steps of:

using a model means describing behavior of the exhaust system of the engine based on the detected air/fuel ratio;

observing an internal state of the exhaust system described by said model means;

estimating the air/fuel ratios of the individual cylinders based on the output of the observing step; and determining the control constant based on the estimated air/fuel ratios of the individual cylinders to calculate the third feedback correction coefficient.

31. A method according to claim 29, further including the steps of:

establishing the control constant with respect to the engine operating conditions for the first feedback correction coefficient and the second feedback correction coefficient; and determining the control constant based on the selected feedback correction coefficient in response to the detected engine operating conditions.

32. A method according to claim 29, wherein the third controller is a PID controller and the control constant is at least one of a P gain, an I gain and a D gain.

33. A method according to claim 29, further including the steps of:

calculating a learning controlled value of the third feedback correction coefficient; and using the learning control value when engine operation is not in a feedback control region.

34. A method according to claim 29, wherein the control law expressed in a recursion formula is an adaptive control law.

35. A method according to claim 29, wherein the feedback correction coefficient is multiplied by the basic quantity of fuel injection.

36. A computer program for controlling fuel metering for an internal combustion engine having a plurality of cylinders and an exhaust system, said computer program comprising the steps of:

detecting an air/fuel ratio of the engine;

detecting engine operating conditions including at least engine speed and engine load;

determining a quantity of fuel injection for a cylinder of the engine based on at least the detected engine operating conditions;

calculating a first feedback correction coefficient, using a control law expressed in a recursion formula, to correct the quantity of fuel injection, such that a controlled variable obtained based on at least the detected air/fuel ratio is brought to a desired value;

calculating a second feedback correction coefficient, using a control law whose control response is less than that of the first control law, to correct the quantity of fuel injection such that the controlled variable is brought to the desired value;

calculating a third feedback correction coefficient using a control constant, to correct the quantity of fuel injection for individual cylinders, such that air/fuel ratio variance among the cylinders decreases;

selecting one of the first feedback correction coefficient and the second feedback correction coefficient in response to the detected engine operating conditions;

correcting the quantity of fuel injection based on the selected feedback correction coefficient and the third feedback correction coefficient to determine an output quantity of fuel injection; and injecting fuel in the cylinder of the engine based on the determined output quantity of fuel injection;

wherein:

discriminating which of the first feedback correction coefficient and the second feedback correction coefficient is selected; and determining the control constant to calculate the third feedback correction coefficient based on the selected feedback correction coefficient.

37. A computer program according to claim 36, further including estimating individual cylinder air/fuel ratios comprising the steps of:

using a model means describing behavior of the exhaust system of the engine based on the detected air/fuel ratio;

observing an internal state of the exhaust system described by said model means;

estimating the air/fuel ratios of the individual cylinders based on the output of the observing step; and determining the control constant based on the estimated air/fuel ratios of the individual cylinders to calculate the third feedback correction coefficient.

38. A computer program according to claim 36, further including the steps of:

establishing the control constant with respect to the engine operating conditions for the first feedback correction coefficient and the second feedback correction coefficient; and determining the control constant based on the selected feedback correction coefficient in response to the detected engine operating conditions.

39. A computer program according to claim 36, wherein the third controller is a PID controller and the control constant is at least one of a P gain, an I gain and a D gain.

40. A computer program according to claim 36, further including the steps of:

calculating a learning control value of the third feedback correction coefficient; and using the learning control value when engine operation is not in a feedback control region.

41. A computer program according to claim 36, wherein the control law expressed in a recursion formula is an adaptive control law.

42. A computer program according to claim 36, wherein the feedback correction coefficient is multiplied by the basic quantity of fuel injection.

43. A system for controlling fuel metering for an internal combustion engine having a plurality of cylinders and an exhaust system, said system comprising:

an air/fuel ratio sensor installed in the exhaust system of the engine for detecting an air/fuel ratio of the engine;

engine operating condition detecting means for detecting engine operating conditions including at least engine speed and engine load;

fuel injection means attached to the engine for injecting fuel into a cylinder of the engine;

a controller coupled to said air/fuel ratio sensor, said engine operating condition detecting means, and said fuel injector for controlling an operation of the engine, said controller being configured to determine a quantity of fuel injection for the cylinder of the engine based on at least the detected engine operating conditions;

calculate a first feedback correction coefficient using a control law expressed in a recursion formula, said first feedback correction coefficient for correcting the quantity of fuel injection wherein a controlled variable obtained based on at least the detected air/fuel ratio detected by said air/fuel ratio sensor is brought to a desired value;

calculate a second feedback correction coefficient, using a control law whose control response is less than that of the first control law to correct the quantity of fuel injection such that the controlled variable is brought to the desired value;

calculate a third feedback correction coefficient, using a control constant to correct the quantity of fuel injection for individual cylinders of the plurality of cylinders, such that air/fuel ratio variance among the cylinders decreases;

select one of the first feedback correction coefficient and the second feed correction coefficient in response to the detected engine operating conditions;

correct the quantity of fuel injection based on the selected feedback correction coefficient and the third feedback correction coefficient to determine an output quantity of fuel injection to be output by the fuel injector means;

discriminate which of the first feedback correction coefficient and the second feedback correction coefficient is selected;

determine the control constant to calculate the third feedback correction coefficient based on the selected feedback correction coefficient; and control said fuel injector to inject a corrected output quantity of fuel injection.

44. A system according to claim 43, wherein said controller is further configured to:

model a behavior of the exhaust system of the engine based upon the output of the air/fuel ratio sensor;

observe an internal state of the exhaust system based upon the modeled behavior; and estimate the air/fuel ratios of the individual cylinders based upon the observed internal state of the exhaust system, wherein the control constant is determined based on the estimated air/fuel ratios of the individual cylinders in order to calculate the third feedback correction coefficient.

45. A system according to claim 44, wherein said controller is further configured to:

establish the control constant with respect to the engine operating conditions for the first feedback correction coefficient and the second feedback correction coefficient, wherein the control constant is determined based on the selected feedback correction coefficient in response to the detected engine operating conditions.

46. A system according to claim 44, wherein said controller utilizes PID control for calculating the third feedback correction coefficient, and the control constant is at least one of a P gain, an I gain, and a D gain.

47. A system according to claim 44, wherein said controller is further configured to:

calculate a learning control value of the third feedback correction coefficient, and to use the learning control value to determine the output quantity of fuel injection when engine operation is determined by said controller not to be in a feedback control region.

48. A system according to claim 44, wherein the controller is configured to utilize an adaptive control law as the control law expressed in a recursion formula.

49. A system according to claim 43, wherein said controller is further configured to:

establish the control constant with respect to the engine operating conditions for the first feedback correction coefficient and the second feedback correction coefficient, wherein the control constant is determined based on the selected feedback correction coefficient in response to the detected engine operating conditions.

50. A system according to claim 49, wherein said controller utilizes PID control for calculating the third feedback correction coefficient, and the control constant is at least one of a P gain, an I gain, and a D gain.

51. A system according to claim 49, wherein said controller is further configured to:

calculate a learning control value of the third feedback correction coefficient, and to use the learning control value to determine the output quantity of fuel injection when engine operation is determined by said controller not to be in a feedback control region.

52. A system according to claim 49, wherein the controller is configured to utilize an adaptive control law as the control law expressed in a recursion formula.

53. A system according to claim 49, wherein said controller is configured to calculate the first feedback correction coefficient using internal variables which include estimated controller parameters which are estimated using adaptive control and adaptation.

54. A system according to claim 49, wherein the controller is configured to multiply the feedback correction coefficient by the basic quantity of fuel injection.

55. A system according to claim 43, wherein said controller utilizes PID control for calculating the third feedback correction coefficient, and the control constant is at least one of a P gain, an I gain, and a D gain.

56. A system according to claim 55, wherein said controller is further configured to:

calculate a learning control value of the third feedback correction coefficient, and to use the learning control value to determine the output quantity of fuel injection when engine operation is determined by said controller not to be in a feedback control region.

57. A system according to claim 55, wherein the controller is configured to utilize an adaptive control law as the control law expressed in a recursion formula.

58. A system according to claim 55, wherein said controller is configured to calculate the first feedback correction coefficient using internal variables which include estimated controller parameters which are estimated using adaptive control and adaptation.

59. A system according to claim 43, wherein said controller is further configured to:

calculate a learning control value of the third feedback correction coefficient, and to use the learning control value to determine the output quantity of fuel injection when engine operation is determined by said controller not to be in a feedback control region.

60. A system according to claim 59, wherein the controller is configured to utilize an adaptive control law as the control law expressed in a recursion formula.

61. A system according to claim 43, wherein the controller is configured to utilize an adaptive control law as the control law expressed in a recursion formula.

62. A system according to claim 43, wherein said controller is configured to calculate the first feedback correction coefficient using internal variables which include estimated controller parameters which are estimated using adaptive control and adaptation.

63. A system according to claim 43, wherein the controller is configured to multiply the feedback correction coefficient by the basic quantity of fuel injection.

* * * * *